US005380178A

United States Patent [19]

Noah

[11] Patent Number: 5,380,178

[45] Date of Patent: Jan. 10, 1995

[54] ROTARY DEVICE AND METHOD OF ASSEMBLY

[75] Inventor: Bruce C. Noah, West Lafayette, Ind.

[73] Assignee: TRW Inc., Lyndhurst, Ohio

[21] Appl. No.: 194,410

[22] Filed: Feb. 10, 1994

[51] Int. Cl.[6] ..... F01C 19/08

[52] U.S. Cl. ..... 418/133; 418/131

[58] Field of Search ..... 418/131, 133, 135, 259, 418/268, 269

[56] References Cited

U.S. PATENT DOCUMENTS

| | | | |
|---|---|---|---|
| 2,694,367 | 11/1954 | Seavey . | |
| 2,966,118 | 12/1960 | McAlvay . | |
| 3,632,238 | 1/1972 | Searle . | |
| 3,787,151 | 1/1974 | Carlson | 418/133 |
| 4,505,655 | 3/1985 | Honaga et al. | 418/133 |

*Primary Examiner*—Richard A. Bertsch
*Assistant Examiner*—Charles G. Freay
*Attorney, Agent, or Firm*—Tarolli, Sundheim & Covell

[57] ABSTRACT

A pump or motor device (22) includes a housing (24) which encloses a rotor (30) disposed within a cam ring (46). A bottom or wear end plate (100) and a top or pressure end plate (156) cooperate with the cam ring (46) and vanes (42) connected with the rotor (30) to form working chambers. The rotary device (22) may be assembled for either a clockwise or counterclockwise rotation. When the rotary device (22) is to be assembled for clockwise rotation, a first set of end plates (100 and 156) is used. When the rotary device (22) is to be assembled for counterclockwise rotation, a second set of end plates (130 and 204) is used. The second set of end plates (130 and 204) includes end plates which are mirror images of the corresponding end plates (100 and 156) in the first set of end plates. During assembly of the rotary device (22), alignment members (282 and 284) cooperate with alignment openings in the end plates (100 and 156 or 130 and 204) and the cam ring (46) to accurately align the end plates and cam ring relative to the housing (24). Interference between a shaft opening (110 or 140) in the bottom end plate (100 or 130) and a drive shaft (32) for the rotary device (22) blocks assembly with the bottom end plate misaligned. Interference between the housing (24) and the top end plate (156 or 204) blocks assembly of the rotary device (22) with the top end plate misaligned.

22 Claims, 13 Drawing Sheets

ROTARY DEVICE AND METHOD OF ASSEMBLY

BACKGROUND OF THE INVENTION

The present invention relates to a rotary device, such as a fluid pump or motor, and a method by which it is assembled.

The end plates and cam rings used in vane type pumps and motors are typically unidirectional. As such, different end plates must be provided for clockwise or counterclockwise rotation. The profile of the working surface in the cam ring is typically an inverted mirror image about a center plane through the minor diameter of the cam ring.

The orientation of the end plates and the cam ring in a pump or motor is critical to proper and efficient operation. Two methods of aligning the end plates with the cam ring and pump or motor body have been previously been used. The first of these two methods is to use two alignment pins spaced 180° apart. These pins pass through holes in the body, lower or wear end plate, cam ring, and top or pressure end plate. The clearance between the holes and pins is held to a slip fit and the angular location of the holes is also closely held. The second method is to use a single alignment pin passing through the assembly. The clearance between the outer diameter of the plates and the cam ring is held very close to the inside diameter of the pump or motor body.

Both of the aforementioned methods accurately locate and position the end plates, cam ring, and pump body. Neither of these alignment methods prevent accidental misassembly of the pump or motor. It is possible with both alignment methods to install the end plates and/or cam ring out of position. Installing the end plates out of position will cause improper operation.

To save wasted effort due to improper assembly both in production and during repair operations in the field, it is desirable to design an end plate alignment system such that is impossible to assemble the pump or motor with the end plates and cam ring incorrectly aligned.

SUMMARY OF THE INVENTION

The present invention relates to a new and improved rotary device, such as a pump or motor, and to a method by which the rotary device is assembled. The rotary device includes an end plate which is capable of being positioned in either an aligned orientation or a misaligned orientation relative to a housing during assembly of the rotary device. In the event that the end plate is positioned in the misaligned orientation relative to the housing during assembly, a shaft opening in the end plate is offset from a shaft opening in the housing. This results in an operating shaft for the rotary device and the end plate interfering to prevent assembly of the rotary device when the end plate is in the misaligned orientation.

In addition, a second or opposite end plate can be positioned in either an aligned orientation or a misaligned orientation relative to the housing during assembly of the rotary device. In the event the second end plate is positioned in the misaligned orientation relative to the housing during assembly, interference between the housing and the second end plate prevents assembly of the rotary device with the second end plate in the misaligned orientation.

In addition, the present invention relates to a method of assembling a rotary device, such as a pump or motor, for operation in either one of two directions. During assembly of the rotary device for operation in one direction, alignment openings in first and second end plates are aligned with alignment openings in a cam ring. During assembly of the rotary device for operation in the second direction, alignment openings in third and fourth end plates are aligned with the alignment openings in the cam ring.

BRIEF DESCRIPTION OF THE DRAWINGS

The foregoing and other features of the present invention will become apparent to one skilled in the art to which the present invention relates upon consideration of the following description of the invention with reference to the accompanying drawings, wherein.

DESCRIPTION OF A SPECIFIC PREFERRED EMBODIMENT OF THE INVENTION

Figure 1:
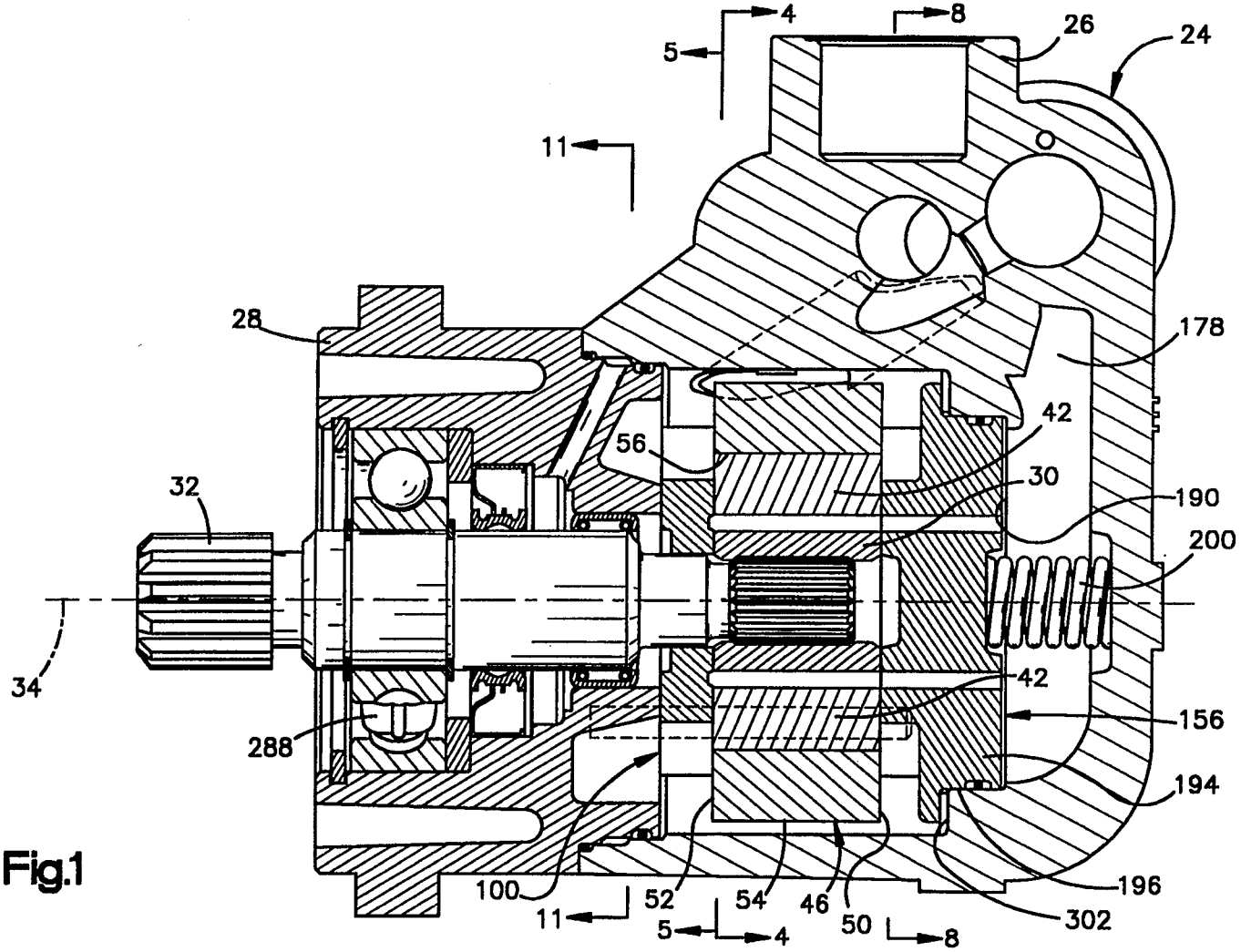
FIG. 1 is a sectional view of a rotary device constructed and assembled in accordance with the present invention.

A rotary device 22, constructed and assembled in accordance with the present invention, is illustrated in FIG. 1. The rotary device 22 may be either a fluid pump or motor. However, in the embodiment of the invention illustrated in FIG. 1, the rotary device 22 is a hydraulic pump.

Figure 2:
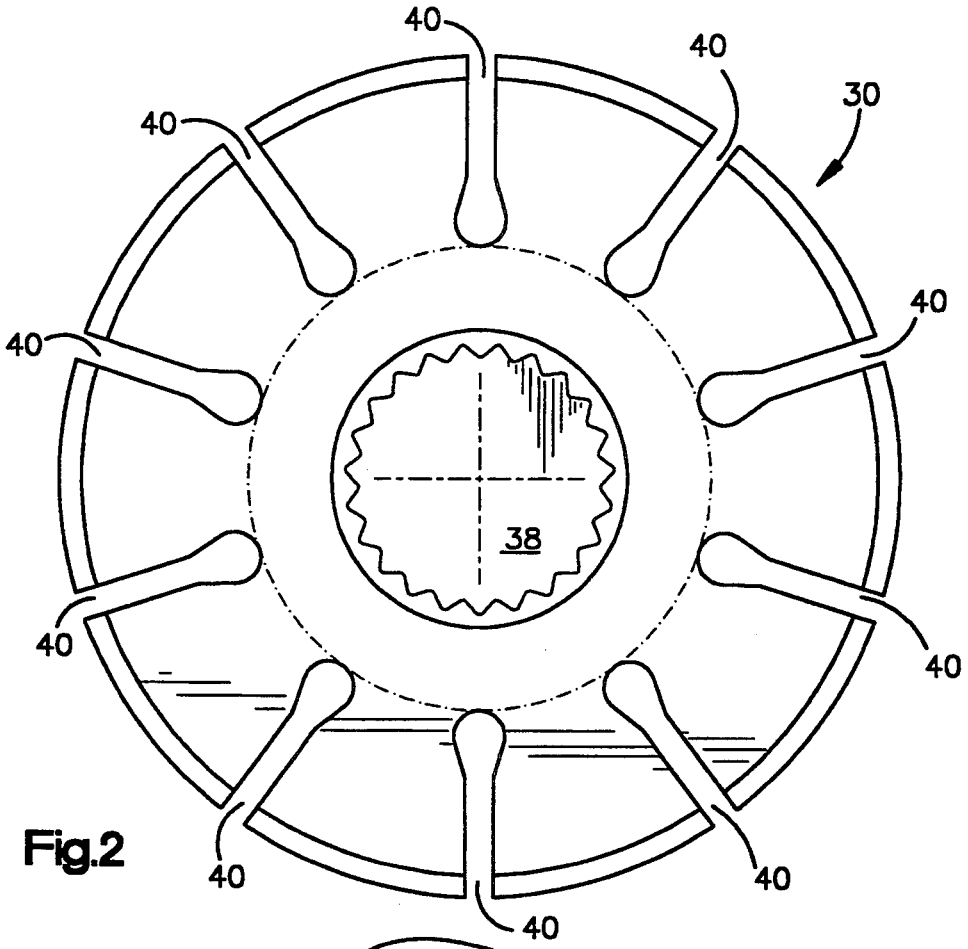
FIG. 2 is an end view of a rotor used in the rotary device of FIG. 1.

The pump 22 includes a housing 24 having a main section 26 and a cover section 28. A rotor 30 is connected to a drive shaft 32. The rotor 30 and drive shaft 32 have a common central axis 34. Rotation of the drive shaft 32 rotates the rotor 30 relative to the housing 24. The rotor 30 (FIG. 2) has a central shaft opening 38 and a plurality of radially extending slots 40. The shaft 32 (FIG. 1) extends into the opening 38 to interconnect the shaft and rotor. Flat vanes 42 (FIG. 1) are slidably mounted in the slots 40 (FIG. 2). The vanes 42 are rectangular plates.

Cam Ring

A cam ring 46 (FIG. 1) extends around the rotor 30 and vanes 42. The vanes 42 and cam ring 46 cooperate in a known manner to form variable volume working chambers. The cam ring 46 has flat parallel circular end surfaces 50 and 52 (FIG. 3) which are interconnected by a cylindrical outer side surface 54.

An inner or working surface 56 has a first operating section 58 (FIG. 4) disposed below a horizontal (as viewed in FIG. 4) center line 60 of the cam ring 46. A second operating section 64 of the inner surface 56 of the cam ring 46 is disposed above the horizontal center line 60. The center line 60 is disposed in a plane which extends perpendicular to the end surfaces 50 and 52 and contains a central axis of the cam ring 46.

The operating sections 58 and 64 (FIG. 4) of the inner surface 56 of the cam ring 46 have the same configuration. Thus, the operating section 58 of the inner surface 56 includes an inlet ramp 66, a dwell section 68 and an outlet ramp 70. Similarly, the second operating section 64 includes an inlet ramp 72, a dwell section 74 and an outlet ramp 76. A pair of dwell sections 78 and 80 interconnect the first and second operating sections 58 and 64.

A first alignment opening 84 extends axially through the cam ring 46. The first alignment opening 84 has a noncircular configuration and has a center disposed on the horizontal center line 60 of the cam ring 46. A horizontal central axis of the first alignment opening 84 extends perpendicular to and intersects the horizontal center line 60 of the cam ring 46.

A second alignment opening 86 extends axially through the cam ring 46. The second alignment opening 86 is cylindrical. The second alignment opening 86 has a horizontal central axis which extends parallel to the outer side surface 54 of the cam ring 46 and perpendicular to the horizontal center line 60 of the cam ring. The central axis of the second alignment opening 86 is offset upward from the horizontal center line 60 of the cam ring 46 by an angle of 2.5°. The centers of the alignment openings 84 and 86 are disposed the same radial distance from the center of the cam ring 46.

A first fluid flow passage 87 extends axially through the cam ring 46. The first fluid flow passage 87 has a cylindrical configuration and has a center disposed upward (as viewed in FIGS. 3 and 4) of the horizontal center line 60 of the cam ring 46. A horizontal central axis of the first fluid flow passage 87 extends parallel to the central axis of the cam ring 46 and perpendicular to the horizontal center line 60 of the cam ring.

A second fluid flow passage 88 extends axially through the cam ring 46. The second fluid flow passage 88 has a horizontal central axis which extends parallel to the central axes of the alignment openings 84 and 86 and to the central axis of the first fluid flow passage 87. The fluid flow passages 87 and 88 are disposed on the same diametral axis of the cam ring 46 and are offset from the horizontal center line 60 of the cam ring by an angle of approximately 20°. The centers of the fluid flow passages 87 and 88 are disposed the same radial distance from the center of the cam ring 46.

Figure 3:
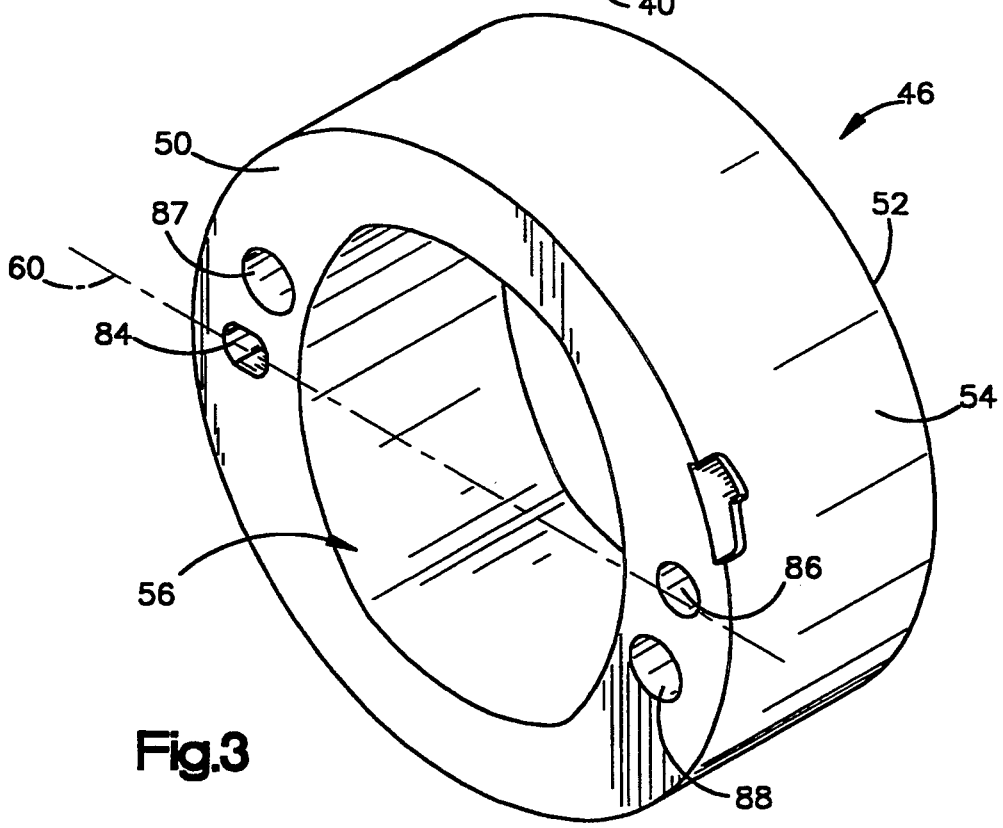
FIG. 3 is a pictorial illustration of a cam ring used in the rotary device of FIG. 1.
Figure 4:
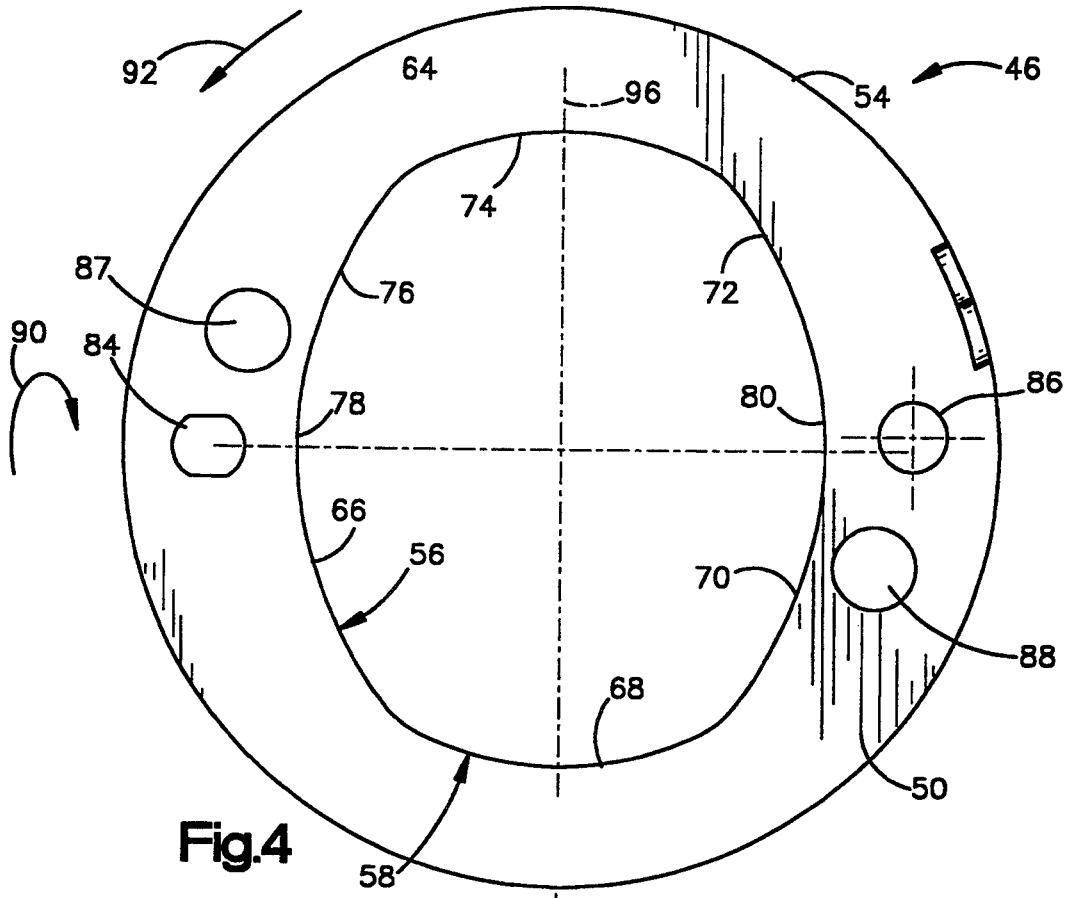
FIG. 4 is a front elevational view, taken generally along the line 4—4 of FIG. 1, further illustrating the construction of the cam ring.

In accordance with one of the features of the present invention, the pump 22 can be assembled so that the drive shaft 32 (FIG. 1) and rotor 30 rotate in either a first or clockwise direction relative to the cam ring 46 or a second or counterclockwise direction relative to the cam ring. The cam ring 46 is shown in FIGS. 3 and 4 in an orientation corresponding to clockwise operation of the pump 22. If the cam ring 46 is to be oriented for counterclockwise rotation of the input shaft 32 and rotor 30, the cam ring is rotated through 180° about the horizontal center line 60 in the manner indicated by the arrow 90 in FIG. 4. The cam ring is then rotated through 90° about its central axis, in the manner indicated by the arrow 92 in FIG. 4.

Rotation of the cam ring through 180° about the center line 60, in the manner indicated by the arrow 90, results in the flat end surface 50 (FIG. 3) of the cam ring 46 facing toward the cover end section 28 (FIG. 1). Rotation of the cam ring 46 through 90° about its central axis, in the manner indicated by the arrow 92, results in the first alignment opening 84 being disposed on a vertical (as viewed in FIG. 4) center line 96 of the cam ring 46. At this time, the second alignment opening 86 is offset by 2.5° to the right of the vertical center line 96 of the cam ring 46. The horizontal and vertical center lines 60 and 96 of the cam ring 46 intersect at the central axis of the cam ring.

Bottom or Wear End Plates

Figure 5:
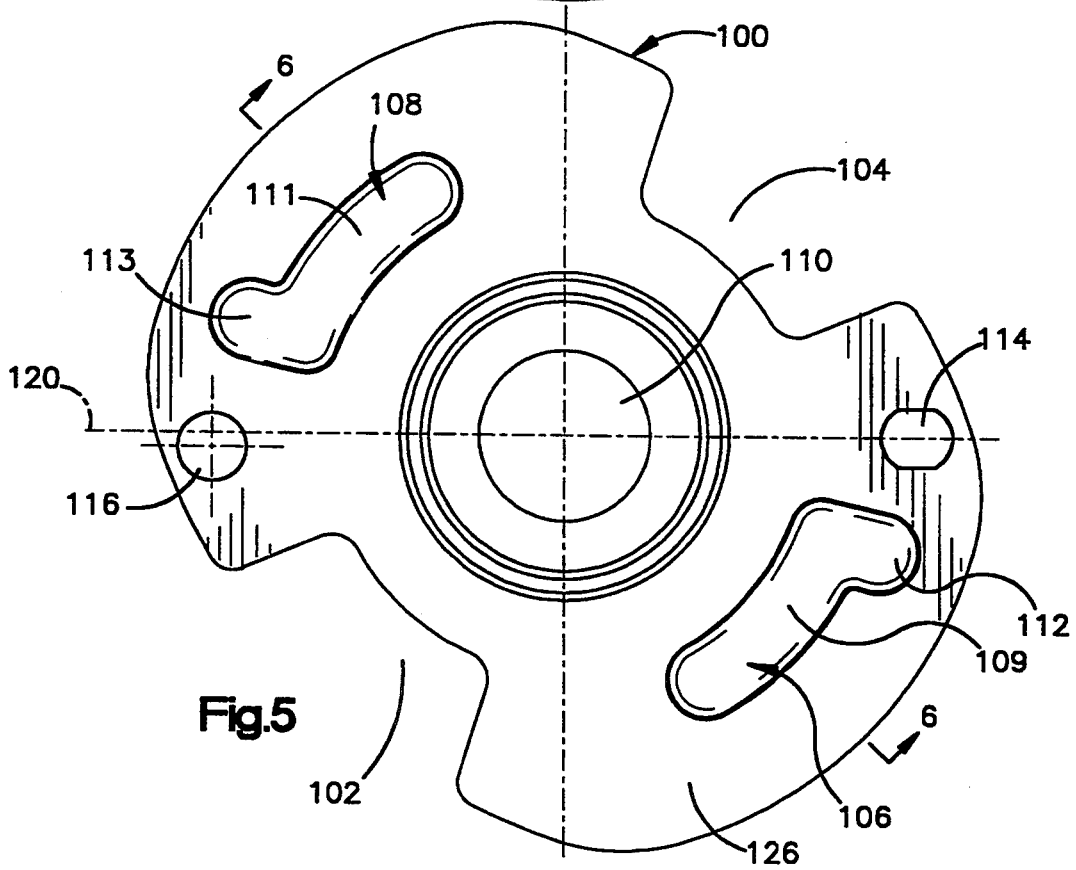
FIG. 5 is a plan view, taken generally along the line 5—5 of FIG. 1; illustrating the construction of a bottom or wear end plate used in the rotary device.
Figure 6:
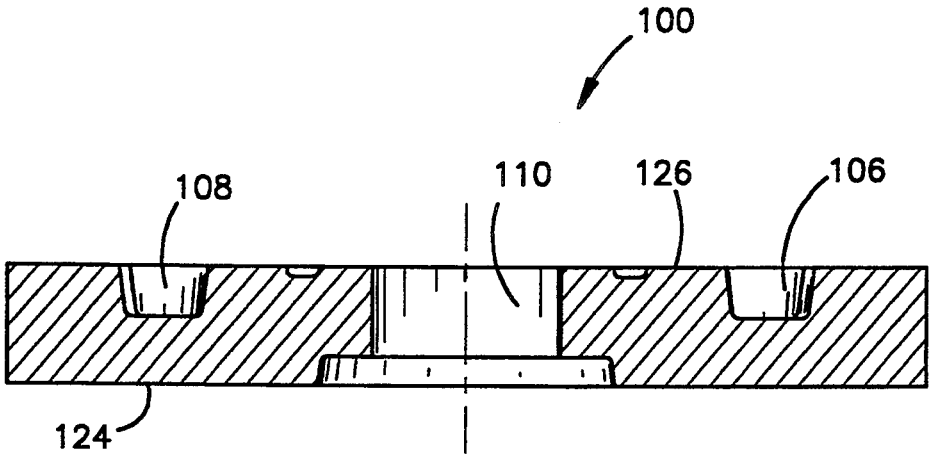
FIG. 6 is a sectional view, taken generally along the line 6—6 of FIG. 5.

A bottom or wear end plate 100 (FIGS. 1, 5 and 6) is used when the pump assembly is assembled for rotation in the first or clockwise direction. The bottom or wear end plate 100 includes a pair of diametrically opposite inlet openings 102 and 104 (FIG. 5) which extend through the end plate. The bottom or wear end plate 100 also has a pair of diametrically opposite outlet openings 106 and 108 (FIGS. 5 and 6). A shaft opening 110 extends axially through the central portion of the bottom wear end plate 100. The shaft opening 110 has a central axis which is coincident with a central axis of the bottom or wear end plate 100 and the axis 34 (FIG. 1) of the rotor 30 and drive shaft 32 (FIG. 1).

The outlet openings 106 and 108 (FIGS. 5 and 6) are closed ended cavities which direct high pressure fluid discharged from working chambers of the pump 22 into the flow passages 87 and 88 (FIG. 4) in the cam ring 46. The outlet openings 106 and 108 (FIG. 6) do not extend through the bottom or wear end plate 100. The outlet openings 106 and 108 (FIG. 5) have arcuate portions 109 and 111 into which high pressure fluid is discharged from working chambers of the pump 22. The outlet openings 106 and 108 have radially extending portions 112 and 113 which overlap open ends of the flow passages 87 and 88 (FIG. 4) in the cam ring 46. The radially extending portions 112 and 113 of the outlet openings 106 and 108 direct fluid flow from the arcuate portions 109 and 111 of the outlet openings into the flow passages 87 and 88 in the cam ring 46.

First and second alignment openings 114 and 116 (FIG. 5) extend axially through the bottom or wear end plate 100. The first alignment opening 114 has a noncircular configuration corresponding to the noncircular configuration of the first alignment opening 84 (FIG. 4) in the cam ring 46. Similarly, the second alignment opening 116 (FIG. 5) has a cylindrical configuration corresponding to the cylindrical configuration of the second alignment opening 86 in the cam ring 46.

The first alignment opening 114 has a central axis which extends perpendicular to and intersects a horizontal (as viewed in FIG. 5) center line 120 of the bottom or wear end plate 100. The second alignment opening 116 has a central axis which extends perpendicular to and is offset downward from the horizontal center line 120 of the bottom wear or end plate 100. The central axis of the second alignment opening 116 is offset from the horizontal center line 120 of the bottom or wear end plate 100 by an angle of 2.5°, the same amount by which the second alignment opening 86 (FIG. 4) in the cam ring 46 is offset from the horizontal center line 60 of the cam ring. The central axes of the alignment openings 114 and 116 are disposed the same radial distance from and extend parallel to the central axis of the bottom or wear end plate 100.

The distance between the central axes of the first and second alignment openings 84 and 86 (FIG. 4) in the cam ring 46 is the same as the distance between the central axes of the first and second alignment openings 114 and 116 (FIG. 5) in the bottom or wear end plate 100. During assembly of the pump 22, the first alignment opening 84 in the cam ring 46 (FIG. 4) is aligned with the first alignment opening 114 (FIG. 5) in the bottom or wear end plate 100 and the second alignment opening 86 in the cam ring is aligned with the second alignment opening 116 in the bottom or wear end plate. By providing the first alignment openings 84 and 114 with similar noncircular configurations, positioning of the first alignment openings relative to each other is facilitated.

The bottom or wear end plate 100 has flat parallel major side surfaces 124 and 126 (FIG. 6). The flat side surface 126 faces toward and engages the end surface 52 (FIG. 3) on the cam ring 46 when the pump 22 is assembled for clockwise rotation (FIG. 1). The flat side surface 124 on the bottom or wear end plate 100 faces toward and engages the cover end section 28 (FIG. 1) of the pump 22.

The bottom or wear end plate 100 (FIGS. 5 and 6) is used in the pump 22 when the rotor 30 and input shaft 32 are to be rotated in a clockwise direction. When the rotor 30 and input shaft 32 are to be rotated in the opposite or counterclockwise direction, an alternative bottom or wear end plate 130 (FIG. 7) is used in the pump 22. Thus, when the pump 22 is to be driven in a clockwise direction, the pump is assembled with the bottom or wear end plate 100 of FIGS. 5 and 6. When the pump 22 is to be driven in a counterclockwise direction, the pump is assembled with the bottom or wear end plate 130 of FIG. 7.

Figure 7:
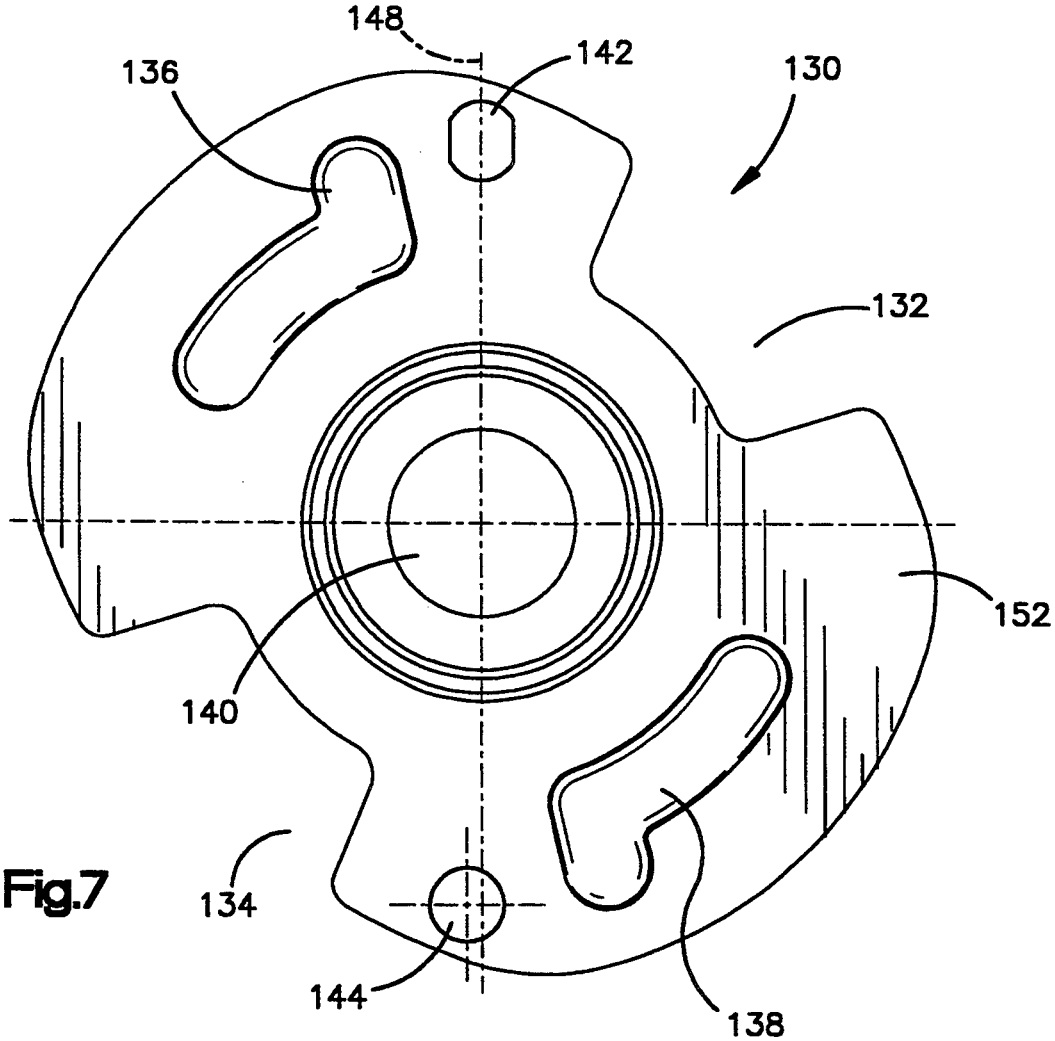
FIG. 7 is a plan view, generally similar to FIG. 5, illustrating an alternative bottom or wear end plate for use in the rotary device of FIG. 1.

The bottom or wear end plate 130 of FIG. 7 is a mirror image of the bottom or wear end plate 100 of FIG. 5. The bottom or wear end plate 130 of FIG. 7 includes a pair of inlet openings 132 and 134. The bottom or wear end plate 130 has a pair of outlet openings 136 and 138. A shaft opening 140 extends through a central portion of the bottom or wear end plate 130. The inlet openings 132 and 134 extend through the bottom or wear end plate 130 while the outlet openings 136 and 138 extend only part way through the bottom or wear end plate.

A first alignment opening 142 and a second alignment opening 144 are formed in the bottom or wear end plate 130. The first alignment opening 142 has a noncircular configuration corresponding to the noncircular configuration of the first alignment opening 84 in the cam ring 46. The second alignment opening 144 in the bottom or wear end plate 130 has a cylindrical configuration corresponding to the cylindrical configuration of the second alignment opening 86 in the cam ring 30.

The alignment opening 142 has a central axis which intersects and extends perpendicular to a vertical (as viewed in FIG. 7) center line 148 of the bottom or wear end plate 130. The alignment opening 144 has a central axis which extends perpendicular to and is offset from the vertical center line 148 of the bottom or wear end plate 130. The central axis of the alignment opening 144 is offset by an angle of 2.5° from the vertical center line 148 of the bottom or wear end plate 130.

A major side surface 152 of the bottom or wear end plate 130 faces toward and engages the end surface 50 (FIG. 3) on the cam ring 46 when the pump is assembled for counterclockwise rotation. An opposite side surface (not shown) of the bottom or wear end plate 130 faces toward and engages the cover end section 28 of the pump 22. When the cam ring 46 is oriented for operation of the pump 22 in the counterclockwise direction, the first alignment opening 142 in the bottom or wear end plate 130 is aligned with the first alignment opening 84 in the cam ring 46. Similarly, the second alignment opening 144 in the wear end plate 130 is aligned with the second alignment opening 86 in the cam ring 46.

Top or Pressure End Plates

A top or pressure end plate 156 (FIG. 8) is used in the pump 22 when the pump is driven in a clockwise direction. The top or pressure end plate 156 includes a pair of inlet openings 158 and 160 which extend only part way through the top or pressure end plate. In addition, the top or pressure end plate 156 has a pair of outlet openings 162 and 164 which extend axially through the top or pressure end plate 156. Radially projecting portions 165 of the outlet openings 162 and 164 overlap discharge ends of the flow passages 87 and 88 in the cam ring 46 (FIG. 4).

A shaft recess 166 (FIG. 9) extends only part way through a central portion of the top or pressure end plate 156. The shaft recess 166 provides clearance for the shaft 32 (FIG. 1) and may be omitted if desired. A plurality of arcuate pressure slots 168, 170, 172 and 174

Figure 8:
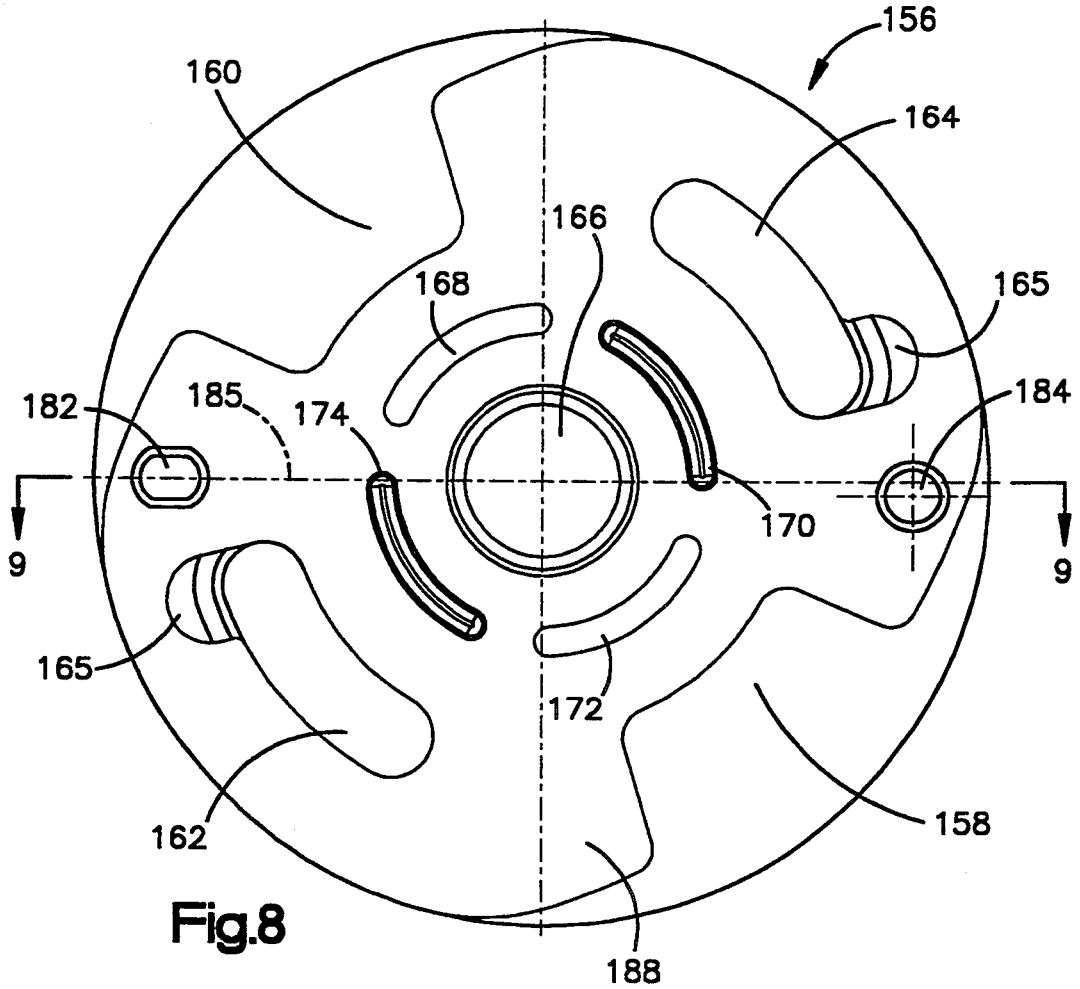
FIG. 8 is a plan view, taken generally along the line 8—8 of FIG. 1, illustrating a top or pressure end plate.
Figure 9:
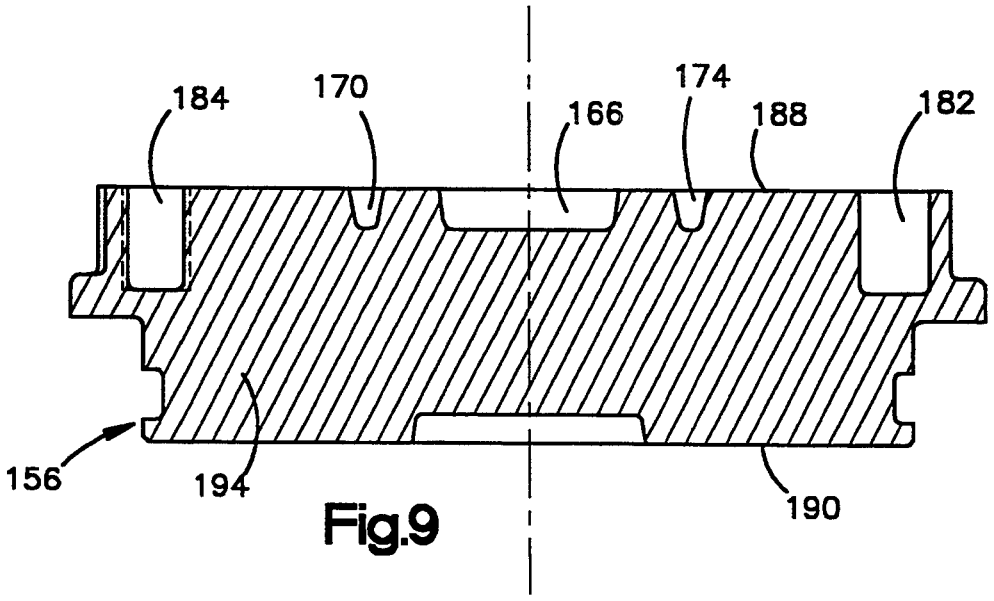
FIG. 9 is a sectional view, taken generally along the line 9—9 of FIG. 8.

(FIG. 8) are formed in the top or pressure end plate 156 (FIGS. 8 and 9). The pressure slots 168 and 172 extend axially through the top or pressure end plate 156 and conduct high pressure fluid from a discharge chamber 178 (FIG. 1) in the pump 22 to a location beneath the vanes 42 in the rotor 30 to press the vanes against the inner side surface 56 on the cam ring 46. The pressure slots 170 and 174 extend only part way through the top or pressure end plate 156 (FIG. 9).

A first alignment opening 182 extends only part way through the top or pressure end plate 156 (FIGS. 8 and 9). The alignment opening 182 has a noncircular configuration corresponding to the noncircular configuration of the first alignment opening 84 in the cam ring 46 (FIG. 4). A second alignment opening 184 extends only part way through the top or pressure end plate 156 (FIGS. 8 and 9). The alignment opening 184 has a cylindrical configuration corresponding to the cylindrical configuration of the second alignment opening 86 (FIG. 4) in the cam ring 46.

A central axis of the alignment opening 182 intersects and extends perpendicular to a horizontal center line 185. The alignment opening 184 has a central axis which is perpendicular to the center line 185. The central axis of the alignment opening 184 is offset at an angle of 2.5° downward (as viewed in FIG. 8) from the center line 185. The parallel central axes of the alignment openings 182 and 184 are located at the same radial distance from a central axis of the top or pressure end plate 156.

When the pump 22 has been assembled for operation in a clockwise direction, the alignment opening 182 (FIG. 8) in the top or pressure end plate 156 is aligned with the alignment opening 84 (FIG. 4) in the cam ring 46. The alignment opening 184 in the top or pressure end plate 156 (FIG. 8) is aligned with the alignment opening 86 (FIG. 4) in the cam ring 46.

The top or pressure end plate 156 has a flat major side surface 188 (FIGS. 8 and 9). The major side surface 188 faces toward and engages the end surface 50 on the cam ring 46 when the pump 22 is assembled for rotation in a clockwise direction. A second major side surface 190 (FIG. 9) on the top or pressure end plate 156 extends parallel to the major side surface 188 and faces away from the cam ring 46 and rotor 30.

The radially projecting portion 165 of the outlet opening 162 (FIG. 8) is aligned with the flow passage 87 (FIG. 3) in the cam ring 46. Similarly, the radially projecting portion 165 of the outlet opening 164 (FIG. 8) is aligned with the flow passage 88 in the cam ring 46. This enables high pressure fluid to be conducted from the outlet openings 106 and 108 (FIG. 5) in the bottom or wear end plate 100 through the cam ring flow passages 87 and 88 (FIG. 3) and the outlet openings 162 and 164 (FIG. 8) in the top or pressure end plate 156 into the pressure chamber 178 (FIG. 1).

The top or pressure end plate 156 has a cylindrical mounting section 194 (FIG. 9) which is received in a cylindrical opening 196 (FIG. 1) formed within the main section 26 of the housing 24. A suitable seal is provided between the mounting section 194 of the top or pressure end plate 156 and the opening 196 in the main section 26 of the housing 24 to block leakage of fluid from the pressure chamber 178 around the top or pressure end plate 156. A coil spring 200 (FIG. 1) is compressed between the main housing section 26 and the top or pressure end plate 156 to press the top or pressure end plate 156 against the cam ring 46 and to press the cam ring 46 against the bottom or wear end plate 100.

A top or pressure end plate 204 (FIG. 10) is used when the pump 22 is assembled for rotation in the counterclockwise direction. The top or pressure end plate 204 is a mirror image of the top or pressure end plate 156 (FIG. 8).

The top or pressure end plate 204 includes a pair of inlet openings 206 and 208. The inlet openings 206 and 208 extend only part way through the top or pressure end plate 204. A pair of outlet openings 210 and 212 extend axially through the top or pressure end plate 204. A shaft recess 214 in a central portion of the top or pressure end plate 204 extends only part way through the top or pressure end plate. The shaft recess 214 is to provide clearance for the drive shaft 32 and may be omitted if desired. A plurality of pressure passages or slots 216, 218, 220 and 222 conduct fluid pressure to the inner ends of the slots 40 to press the vanes 42 against the inner side surface 56 of the cam ring 46.

A first alignment opening 226 extends only part way through the top or pressure end plate 204 and has a noncircular configuration corresponding to the noncircular configuration of the first alignment opening 84 (FIG. 4) in the cam ring 46. A second alignment opening 228 extends only part way through the top or pressure end plate 156 and has a cylindrical configuration corresponding to the cylindrical configuration of the second alignment opening 86 in the cam ring 46.

When the pump 22 is assembled for rotation in a counterclockwise direction, the first alignment opening 226 in the top or pressure end plate is aligned with the first alignment opening 84 in the cam ring 46 and the second alignment opening 228 in the top or pressure end plate 204 is aligned with the second alignment opening 86 in the cam ring 46. At this time, a flat major side surface 232 of the top or pressure end plate 204 is disposed in abutting engagement with the flat end surface 50 of the cam ring 46. The top or pressure end plate 204 has a cylindrical mounting section (not shown) which is received in the cylindrical opening 196 (FIG. 1) in the main section 26 of the housing 24.

Cover Section

The cover section 28 (FIG. 11) cooperates with the bottom or wear end plate 100 to form portions of inlet chambers. The cover section 28 includes a pair of inlet openings 236 and 238. In addition, the cover section 28 has a pair of recesses 240 and 242 which are provided to reduce the amount of metal in the cover section 28. The recesses 240 and 242 do not have any functional purpose during operation of the pump assembly 22.

In accordance with a feature of the invention, alignment openings are formed in the cover section 28. Thus, a first set 246 of alignment openings is provided for use during assembly of the pump 22 for clockwise rotation. A second set 248 of alignment openings is provided for use during assembly of the pump 22 for counterclockwise rotation.

The first set 246 of alignment openings includes a first alignment opening 252 which extends only part way through the cover section 28. The first alignment opening 252 has a central axis which extends perpendicular to and intersects a horizontal center line 254 of the cover section 28. When the pump 22 is assembled for clockwise rotation, the center line 254 of the cover section 28 is in the same plane as the center line 60 of the cam ring 46 (FIG. 4), the center line 120 (FIG. 5) of the bottom or wear end plate 100, and the center line 185 (FIG. 8) of the top or pressure end plate 156.

A second alignment opening 256 (FIG. 11) extends only part way through the cover section 28 and has a central axis which extends perpendicular to and is offset from the horizontal center line 254. The central axis of the second alignment opening 256 is offset downward (as viewed in FIG. 11) by an angle of 2.5° from the horizontal center line 254 of the cover section 28. In the illustrated embodiment of the invention, the first and second alignment openings 252 and 256 (FIG. 11) have the same configuration.

The second set 248 of alignment openings includes a first alignment opening 260 having a central axis which extends perpendicular to and intersects a vertical center line 262 of the cover section 28. A second alignment opening 264 in the second set 248 of alignment openings has a central axis which extends perpendicular to and is offset from the center line 262. The central axis of the second alignment opening 264 is offset to the right (as viewed in FIG. 11) of the vertical center line 262 by an angle of 2.5°. The central axes of the alignment openings 252, 256, 260 and 264 all have the same configuration and all extend parallel to a central axis of a shaft opening 270 which extends through a central portion of the cover section 28.

Figure 11:
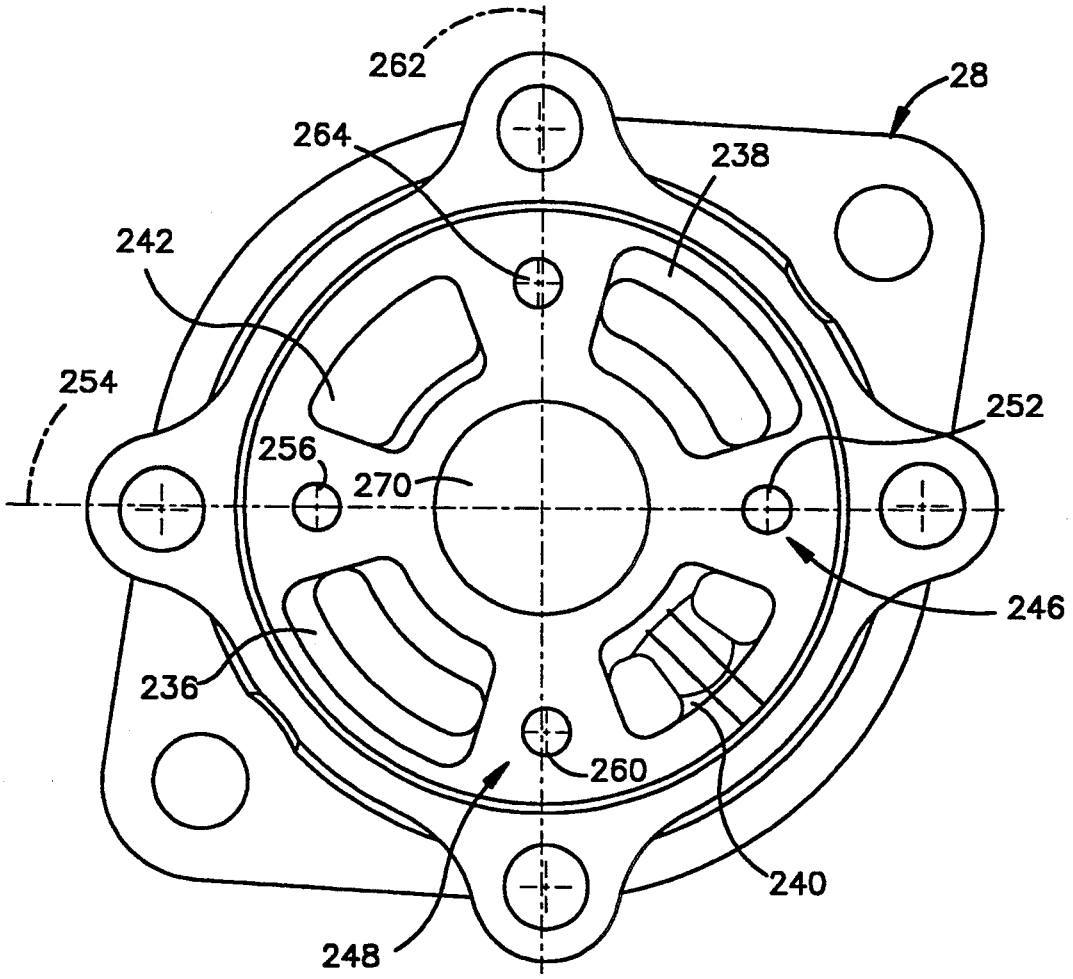
FIG. 11 is a simplified plan view, taken generally along the line 11—11 of FIG. 1, of a cover section of a housing of the rotary device.

When the pump 22 is assembled to be driven in a clockwise direction, the first and second openings 84 and 86 (FIG. 4) in the cam ring 46, the first and second alignment openings 114 and 116 (FIG. 5) in the bottom or wear end plate 100, and the first and second alignment openings 182 and 184 (FIG. 8) in the top or pressure end plate 156 are aligned with the alignment openings 252 and 256 (FIG. 11) in the cover section 28. At this time, the end surface 52 (FIG. 3) on the cam ring 46 faces toward the bottom or wear end plate 100 (FIG. 5) and the cover section 28 (FIGS. 1 and 11).

Similarly, when the pump 22 is assembled for counterclockwise rotation, the first and second alignment openings 84 and 86 (FIG. 4) in the cam ring 46, the first and second alignment openings 142 and 144 (FIG. 7) in the bottom or wear end plate 130 and the first and second openings 226 and 228 (FIG. 10) in the top or pressure end plate 204 are aligned with the alignment openings 260 and 264 (FIG. 11) in the cover section 28. At this time, the end surface 50 (FIG. 3) on the cam ring 46 faces toward the bottom or wear end plate 130 (FIG. 7) and cover section 28 (FIG. 11).

Although it is preferred to use four alignment openings 252, 256, 260 and 264 (FIG. 11) in the cover section 28, it should be understood that only three alignment openings could be provided in the cover section 28 if desired. For example, the alignment opening 256 in the cover section 28 could be omitted. If this was done, the alignment opening 264 would be used in conjunction with assembly of the pump 22 for both clockwise and counterclockwise rotation. The use of only three alignment openings in the cover section 28, that is alignment openings 252, 260 and 264 would require changing of the location of the alignment opening 116 (FIG. 5) in the bottom or wear end plate 100 and the alignment opening 144 (FIG. 7) in the bottom or wear end plate 130 to correspond to the location of the alignment opening 264 (FIG. 11) in the cover section 28. Similarly, the location of the alignment opening 184 (FIG. 8) in the top or pressure end plate 156 and the alignment opening 228 (FIG. 10) in the top or pressure end plate 204 would have to be changed to correspond to the location of the alignment opening 264 (FIG. 11) in the cover section 28. In addition, a third alignment opening would have to be provided in the cam ring 46.

Assembly

The pump 22 can be assembled for either clockwise or counterclockwise rotation of the rotor 30 and drive shaft 32 relative to the cam ring 46 (FIG. 1). If the pump 22 is to be assembled for counterclockwise rotation, the cam ring 46 is oriented with the end surface 50 toward the bottom or wear plate 130 (FIG. 7) and cover section 28. The top or pressure end plate 204 (FIG. 10) is used with the cam ring 46.

If the pump 22 is to be assembled for clockwise rotation, the cam ring 46 is oriented with the end surface 52 toward the bottom or wear end plate 100 (FIG. 5) and cover section 28. The top or pressure end plate 156 (FIG. 8) is used with the cam ring 46.

When the pump 22 is to be assembled for clockwise rotation, a first cylindrical alignment pin 282 (FIG. 12) is slidably mounted in the first alignment opening 252 (FIG. 11) in the first set 246 of alignment openings in the cover section 28. A second cylindrical alignment pin 284 (FIG. 12) is mounted in the second alignment opening 256 (FIG. 11) in the first set 246 of alignment openings in the cover section 28. The alignment pins 282 and 284 (FIG. 12) are identical and have central axes which extend parallel to the central axis 34 of the drive shaft 32.

The drive shaft 32 is supported in the cover section 28 by a bearing assembly 288. It should be understood that the alignment pin 284 is mounted in a portion of the cover section 28 which has been broken away in FIG. 12. Therefore, the alignment pin 284 is shown schematically in dash-dot lines in FIG. 12.

Figure 12:
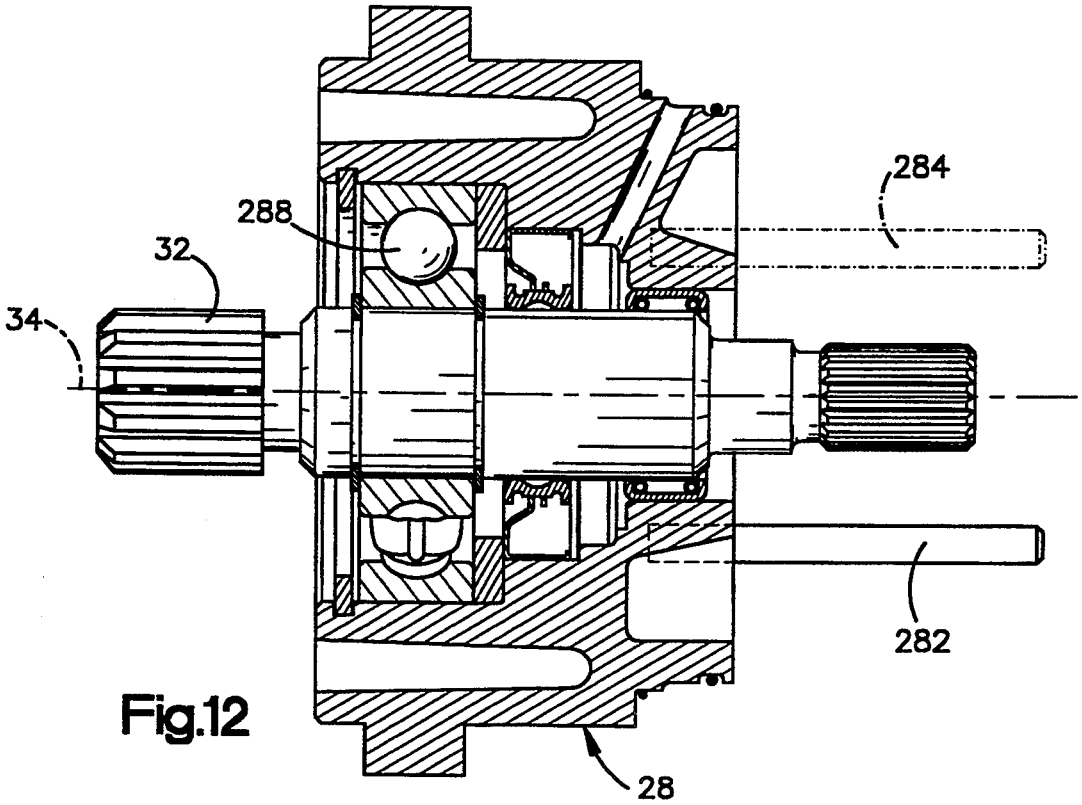
FIG. 12 is a schematic sectional view, illustrating the relationship of a pair of alignment pins to the cover section of the housing at the beginning of assembly of the rotary device of FIG. 1.

Once the alignment pin 282 has been positioned in the first alignment opening 252 (FIG. 11) in the cover section 28 and the second alignment pin 284 has been positioned in the second alignment opening 256 in the cover section 28, as shown in FIG. 12, the bottom or wear end plate 100 is positioned on the alignment pins 282 and 284. The first alignment pin 282 extends through the first alignment opening 114 (FIGS. 5 and 14) in the bottom or wear end plate 100. The second alignment pin 284 extends through the second alignment opening 116 in the bottom or wear end plate 100. The shaft 32 extends through the shaft opening 110 in the bottom or wear end plate 100. At this time, the major side surface 124 (FIG. 13) on the bottom or wear end plate 100 faces downward toward and engages the cover section 28 and the opposite major side surface 126 on the bottom or wear end plate 100 faces upward.

Figure 13:
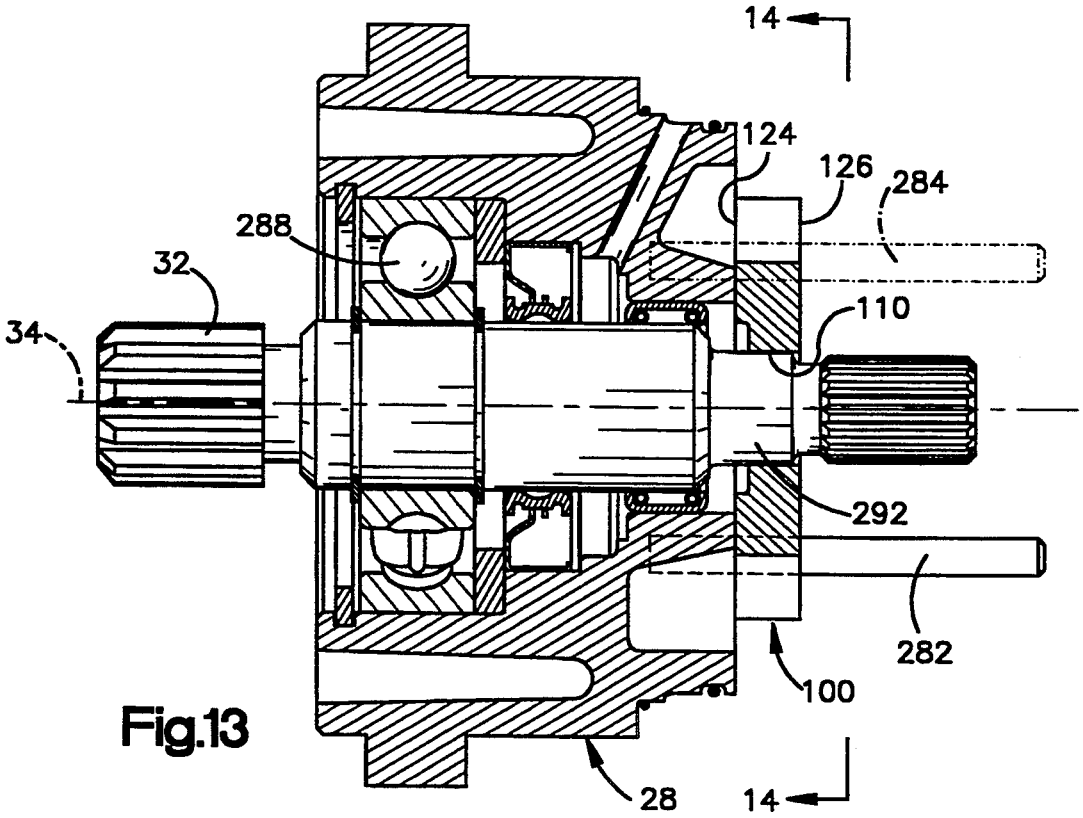
FIG. 13 is a schematic sectional view, generally similar to FIG. 12, illustrating the manner in which the bottom or wear end plate is positioned on the alignment pins.
Figure 14:
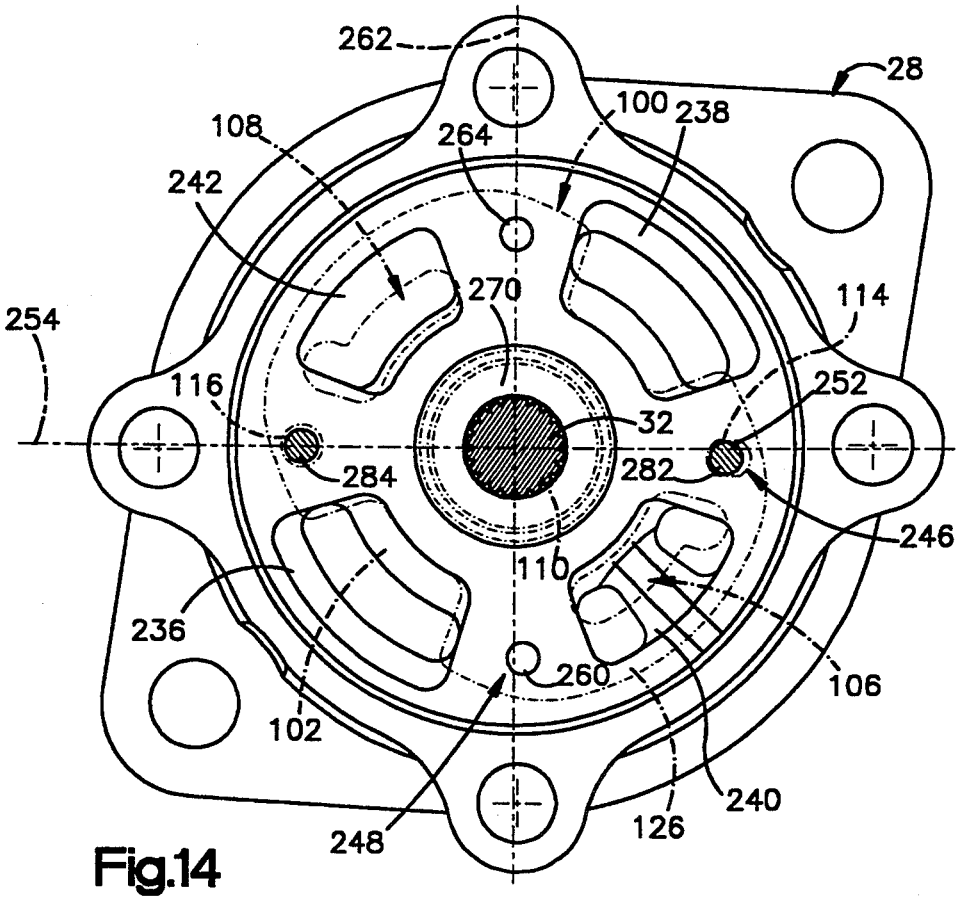
FIG. 14 is a schematic plan view, taken generally along the line 14—14 of FIG. 13, illustrating the relationship of a bottom or wear end plate to the cover section of the housing.

The bottom or wear end plate 100 has been shown in FIGS. 13 and 14 in a properly aligned condition. The central axis of the bottom or wear end plate is coincident with the central axis 34 (FIG. 13) of the drive shaft 32. In addition, the inlet openings 102 and 104 (FIG. 14) in the bottom or wear end plate 100 are aligned with the inlet openings 236 and 238 in the cover section 28. At this time, the first and second alignment openings 260 and 264 (FIGS. 11 and 14) in the second set 248 of alignment openings are empty while the alignment pins 282 and 284 are disposed in the alignment openings 252 and 256 in the first set 246 of alignment openings.

If an attempt is inadvertently made to assemble the pump 22 with the bottom or wear end plate 100 offset by approximately 180° from its intended position (FIGS. 15 and 16), there will be interference between the bottom or wear end plate 100 and the drive shaft 32

Figure 15:
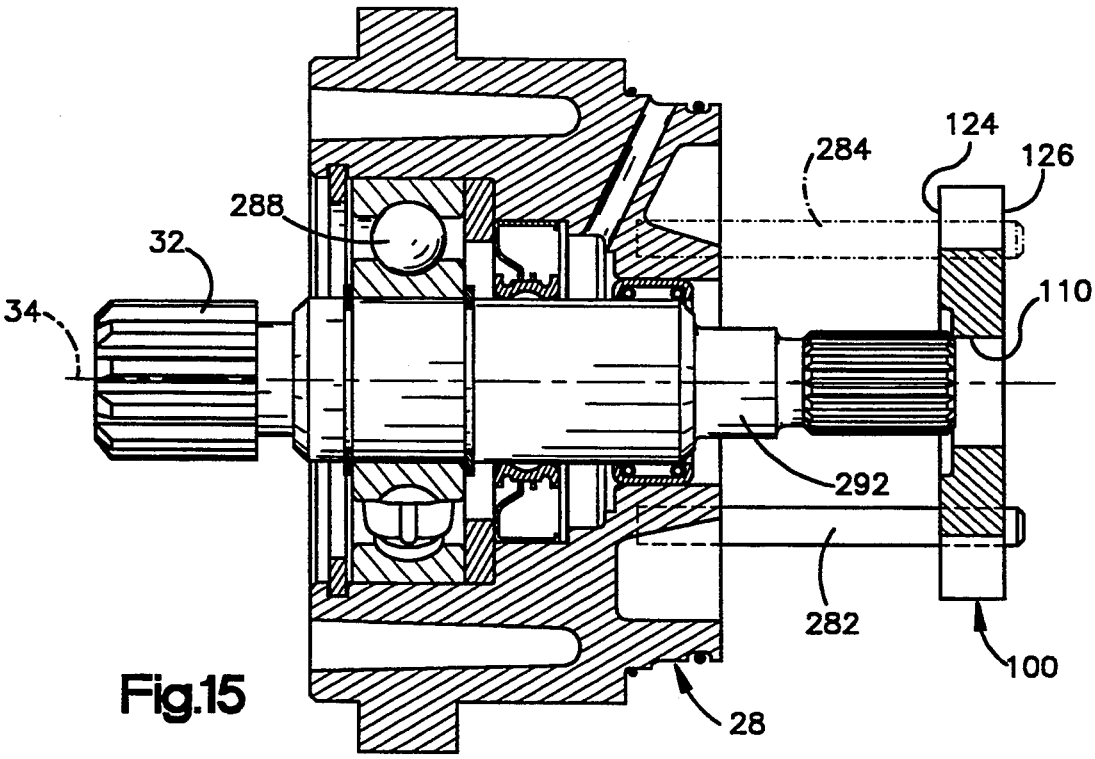
FIG. 15 is a schematic sectional view, generally similar to FIG. 13, illustrating the manner in which a misaligned bottom or wear end plate and a shaft of the rotary device interfere to block assembly.

(FIG. 15). This interference results from the fact that the first alignment openings 114 and 252 in the bottom or wear end plate 100 and cover section 114 are disposed on the axes 120 and 254 (FIGS. 5 and 11) while the second alignment openings 116 and 256 in the bottom or wear end plate and cover section are offset from the axes 120 and 254.

Figure 16:
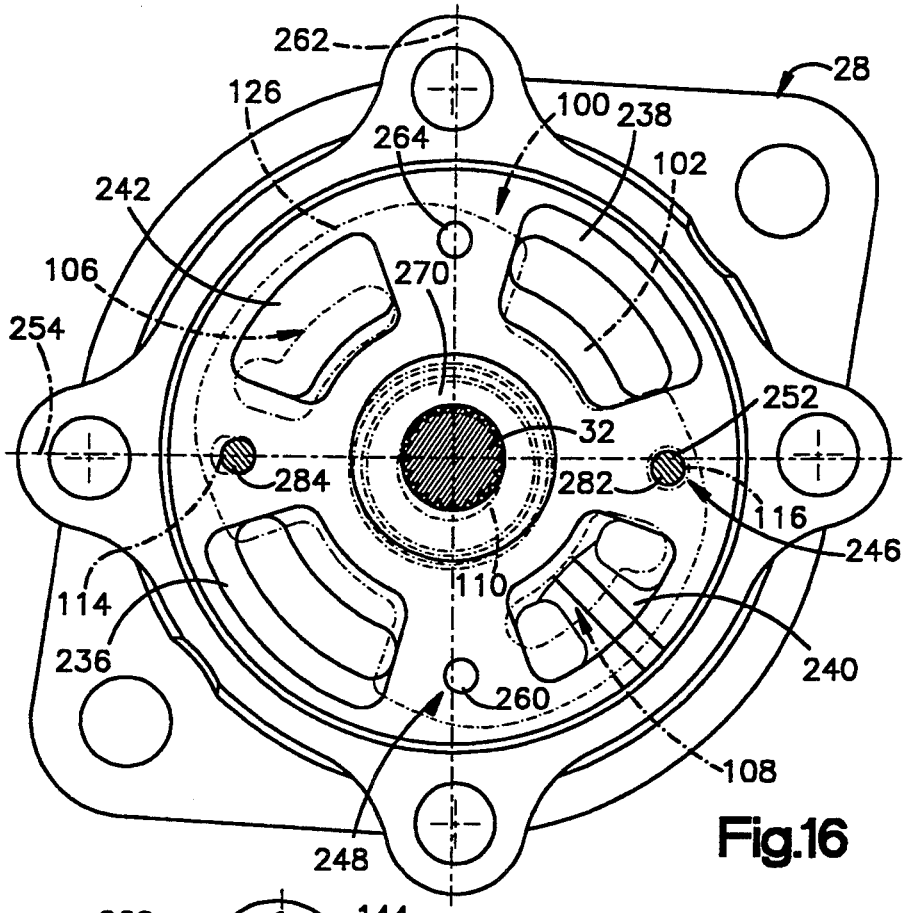
FIG. 16 is a schematic plan view, taken generally along the line 16—16 of FIG. 15 and further illustrating the relationship of the misaligned end plate to the cover section of the housing.

When an attempt is made to assemble the pump 22 with the bottom or wear end plate 100 in the misaligned orientation shown in FIGS. 15 and 16, the second alignment pin 284 extends through the first alignment opening 114 and the first alignment pin 282 extends through the second alignment opening 116. The central axis of the shaft opening 110 in the bottom or wear end plate 100 is offset from the central axis of the shaft 34. This results in interference between the wear plate 100 and shaft 34 (FIG. 15) when an attempt is made to position the bottom or wear end plate 100 relative to the cover section 28.

The interference between the bottom or wear end plate 100 and the shaft 32 blocks assembly of the pump 22 with the bottom or wear plate in the misaligned orientation. The interference between the bottom or wear end plate 100 and the shaft 32 has been illustrated in FIG. 15 as occurring at the outer end of the shaft. It is possible that the outer end portion of the shaft 34 could be small enough so that the interference between the bottom or wear end plate 100 and the shaft does not occur until the bottom or wear end plate has moved downward (as viewed in FIG. 15) along the shaft 32 to a cylindrical shoulder 292 which engages the shaft opening 110 when the bottom or wear end plate 100 is installed in an aligned orientation (FIG. 13).

Once the bottom or wear end plate 100 has been properly positioned on the shaft 32, the cam ring 46 (FIG. 17) is installed. To install the cam ring 46 in alignment with the bottom or wear end plate 100, the first alignment pin 282 is inserted into the first alignment opening 84 (FIG. 4) and the second alignment pin 284 is inserted into the second alignment opening 86 in the cam ring 46. Since the pump 22 is to be assembled for rotation in the clockwise direction, the cam ring 46 is installed with the flat end surface 52 downward toward the bottom or wear end plate 100. Thus, the flat end surface 52 on the cam ring 46 is disposed in abutting engagement with the flat side surface 126 on the bottom or wear end plate 100.

The flow passage 87 (FIG. 3) in the cam ring 46 is aligned with the radially extending portion 112 (FIG. 5) of the outlet opening 106. Similarly, the flow passage 88 (FIG. 3) in the cam ring 46 is aligned with the radially extending portion 113 (FIG. 5) of the outlet openings 108. This enables the outlet openings 106 and 108 in the bottom or wear end plate 100 to direct high pressure fluid from working chambers of the pump 22 into the flow passages 87 and 88 in the cam ring 46.

Figure 17:
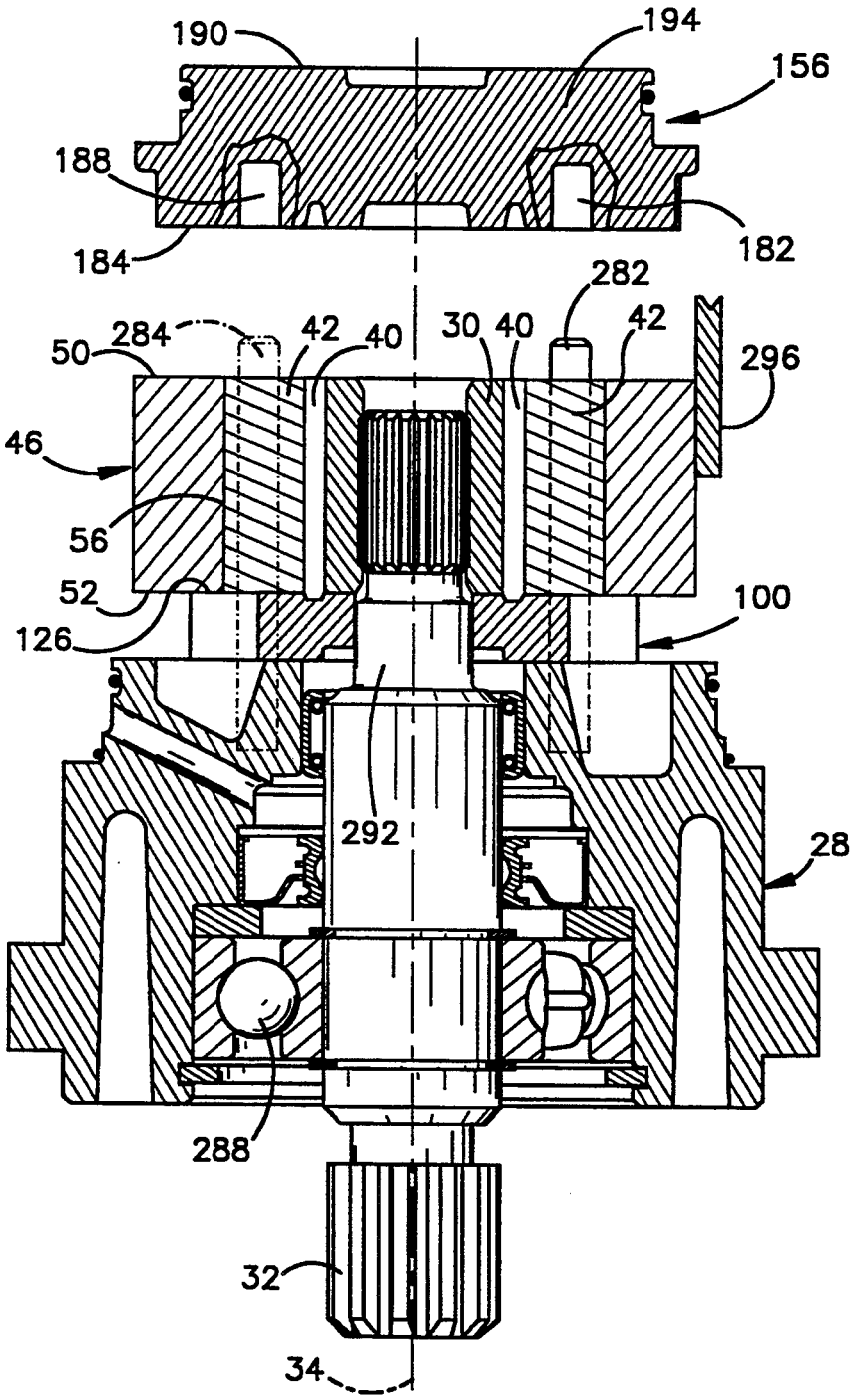
FIG. 17 is a schematic sectional view, generally similar to FIG. 13, illustrating the manner in which the rotor and cam ring are positioned relative to the cover section of the housing during assembly of the rotary device of FIG. 1.

If an attempt is made to install the cam ring 46 in a misaligned orientation, that is, with the first alignment pin 282 extending through the second alignment opening 86 (FIG. 4) and the second alignment pin 284 extending through the first alignment opening 84 in the cam ring, the cam ring will be offset, toward the right, as viewed in FIG. 17. This offset can be detected visually because the cam ring 46 will not be concentric with the cover section 28 of the housing 24. However, during assembly of the pump 22, an arm 296 (FIG. 17) of an assembly fixture may be provided to prevent the cam ring 46 from being positioned on the alignment pins 282 and 284 in a misaligned orientation. If an attempt is made to position the first alignment pin 282 in the second alignment opening 86 (FIG. 4) in the cam ring 46 and the second alignment pin 284 in the first alignment opening 84 in the cam ring, the arm 296 would block engagement of the cam ring 46 with the alignment pins.

After the cam ring 46 has been installed, in the manner shown in FIG. 17, the rotor 30 is installed on a splined upper (as viewed in FIG. 17) end of the shaft 32. The vanes 42 are then inserted into the slots 40 in the rotor 30.

The top or pressure end plate 156 is positioned on the alignment pins 282 and 284 with the first alignment pin 282 extending into the first alignment opening 182 in the top or pressure end plate 156 (FIG. 8) and the second alignment pin 284 extending into the second alignment opening 184 in the top or pressure end plate. The alignment openings 182 and 184 do not extend through the top or pressure end plate 156. Therefore, the upper (as viewed in FIG. 17) ends of the alignment pins 282 and 284 are enclosed by the top or pressure end plate 156.

Once the top or pressure end plate 156 has been properly installed on the alignment pins 282 and 284, the main section 24 (FIG. 1) of the housing is positioned over the stack of pump components on the alignment pins 282 and 284 and moved into engagement with the cover section 28 in the manner shown in FIG. 1. As the main section 26 of the housing 24 moves into engagement with the cover section 28, the mounting section 194 of the top or pressure end plate 156 telescopically moves into the opening 196 (FIG. 1) in the main housing section 26. Suitable retaining bolts (not shown) are inserted through openings in main section 26 and cover section 28 to fixedly interconnect the sections of the housing 24.

If the top or pressure end plate 156 is positioned in a misaligned orientation on the alignment pins 282 and 284 (FIG. 18), the top or pressure end plate 156 will be offset to the right (as viewed in FIG. 18) of its intended position. Thus, if the first alignment pin 282 is positioned in the second alignment opening 184 (FIG. 8) in the top or pressure end plate 156 and the second alignment pin 284 is positioned in the first alignment opening 182 in the top of pressure end plate, the top or pressure end plate will be offset relative to the cam 46 in the manner illustrated in FIG. 18.

Figure 18:
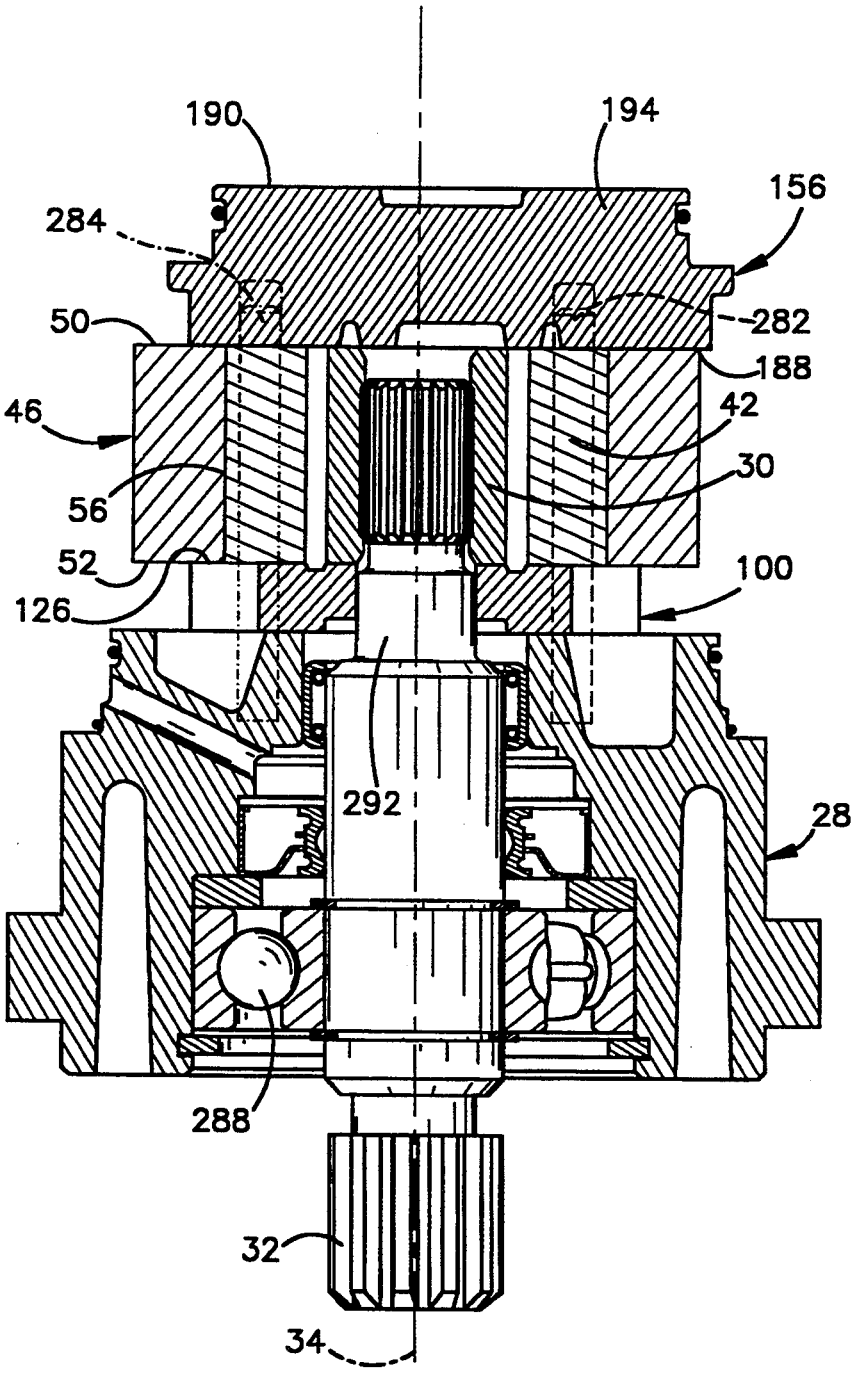
FIG. 18 is a schematic sectional view, generally similar to FIG. 17, illustrating a misaligned top or pressure end plate.
Figure 19:
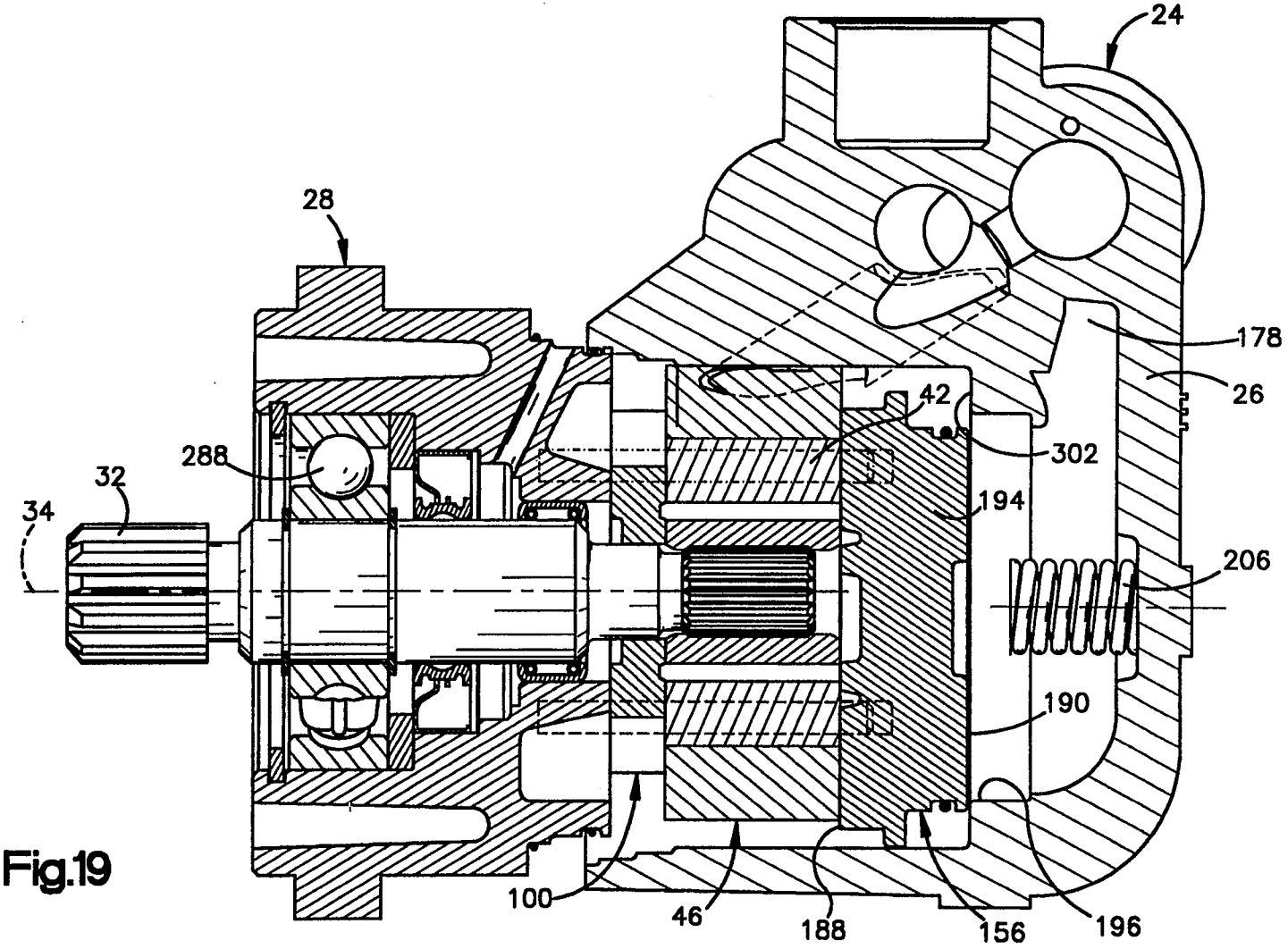
FIG. 19 is a sectional view illustrating the manner in which the misaligned top or pressure end plate of FIG. 18 engages a part of the housing to block assembly of the rotary device.

With the top or pressure end plate 156 in the misaligned position of FIG. 18, the flat outer major side surface 190 on the top or pressure end plate 156 will engage an annular shoulder 302 in the main housing section 26 in the manner illustrated in FIG. 19. This blocks engagement of the main housing section 26 with the cover section 28. Therefore, assembly of the pump 22 with the top or pressure end plate 156 in the misaligned orientation shown in FIGS. 18 and 19 is prevented.

Figure 10:
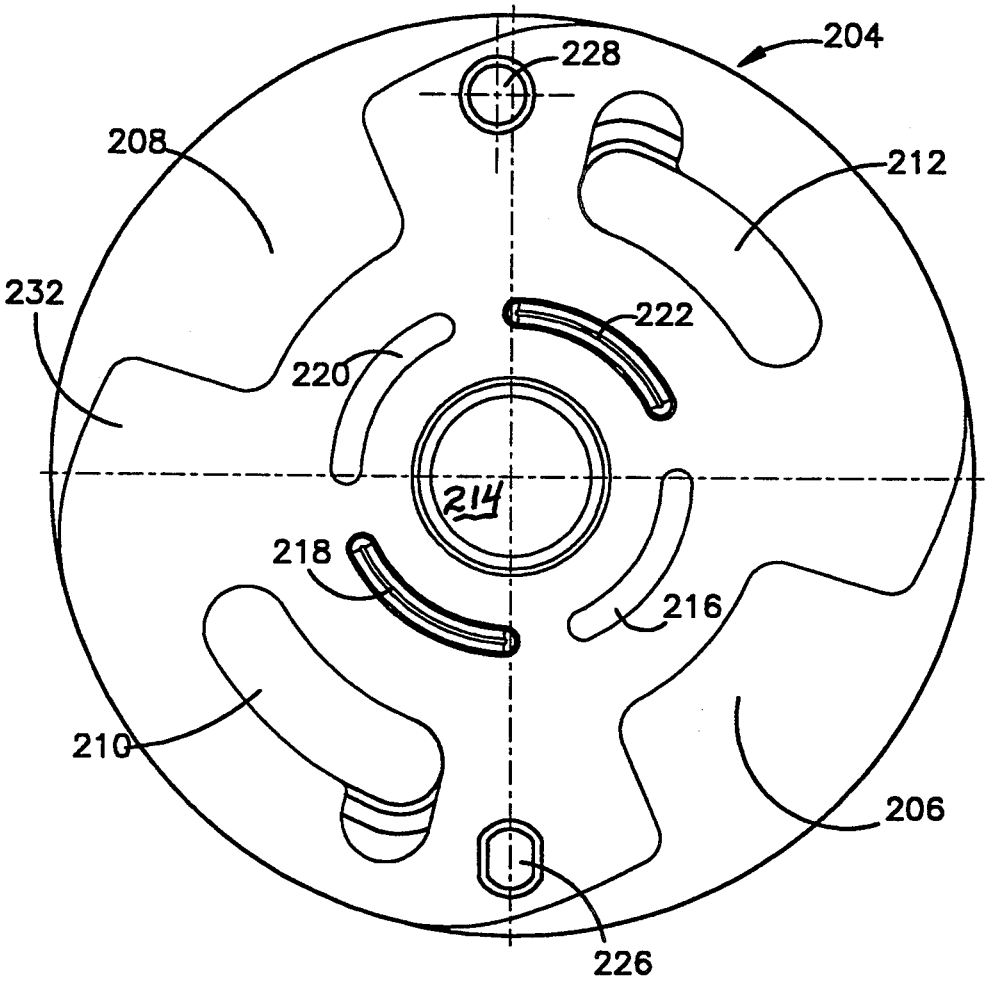
FIG. 10 is a plan view, generally similar to FIG. 8, of an alternative top or pressure end plate for use in the rotary device of FIG. 1.
Figure 20:
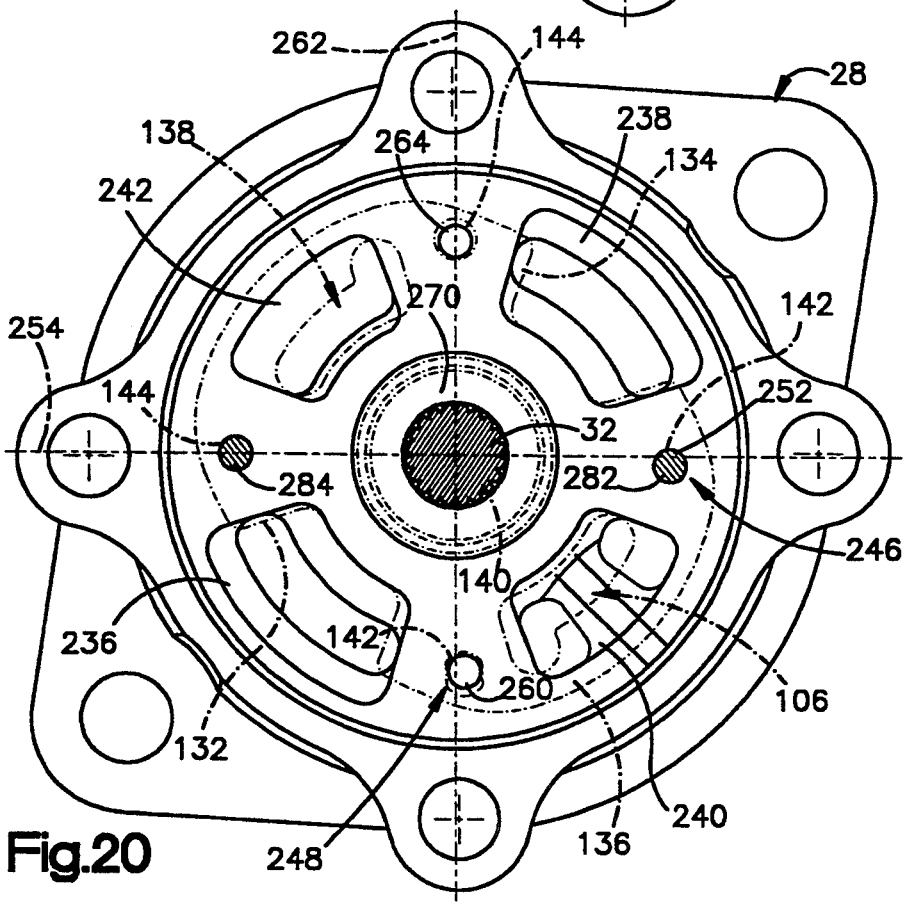
FIG. 20 (on sheet 10 of the drawings) is a plan view, generally similar to FIG. 14, illustrating the relationship of a bottom or wear end plate to the cover end section of the housing of a rotary device which is operated in a direction opposite to the direction of operation of the rotary device of FIG. 14.

When the pump 22 is to be driven in a counterclockwise direction, the alternative bottom or wear end plate 130 (FIGS. 7 and 20) is substituted for the bottom or wear end plate 100 of FIG. 6. The alternative top or pressure end plate 204 of FIG. 10 is substituted for the top or pressure end plate 156 of FIG. 8. In addition, the orientation of the cam ring 46 is changed. Thus, the cam ring 46 is installed with the end surface 50 facing toward the bottom or wear end plate 130 and cover section 28.

When the pump 22 is to be assembled for counterclockwise rotation, the alignment pins 282 and 234 are positioned in the second set 248 (FIG. 11) of alignment openings in the cover 28. Thus, the first alignment pin 282 is positioned in the first alignment opening 260 of the second set 248 of alignment openings and the second alignment pin 284 is positioned in the second alignment opening 264 of the second set of alignment openings. This results in the first alignment pin 282 being disposed on the center line 262 (FIG. 11) of the cover section 28 and the second alignment pin 284 being disposed at a location offset at an angle of 2.5° from the vertical center line 262 of the cover section 28.

Once the first alignment pin 282 has been positioned in the first alignment opening 260 and the second alignment pin 284 has been positioned in the second alignment opening 264, the pump 22 is assembled in the same manner as previously described in conjunction with a pump which is to be driven in a clockwise direction. Thus, the alternative bottom or wear end plate 130 is positioned on the first and second alignment pins 282 and 284 with the first alignment pin 282 extending through the first alignment opening 142 (FIG. 20) and the second alignment pin 284 extending through the second alignment opening 144 in the alternative bottom or wear end plate 130. The alternative bottom or wear end plate 130 is moved along the alignment pins 282 so that the shaft 32 extends through the shaft opening 140 in the alternative bottom or wear end plate 130. This results in the alternative bottom or wear end plate 130 being positioned in engagement with the cover section 28 in the same manner as shown for the bottom or wear end plate 100 in FIG. 13.

If the alternative bottom or wear end plate 130 should be misaligned relative to the cover section 28 by inserting the first alignment pin 282 through the second alignment opening 144 (FIGS. 7 and 20) in the alternative bottom or wear end plate 130 and the second alignment pin 284 through the first alignment opening 142 in the alternative bottom or wear end plate, the alternative bottom or wear end plate will interfere with the shaft 32 in the manner shown in FIG. 15 for the bottom or wear end plate 100. Therefore, engagement of the misaligned alternative bottom or wear end plate 130 with the shaft 32 will block assembly of the pump 22 with the alternative bottom or wear end plate in a misaligned orientation.

After the alternative bottom or wear end plate 130 has been properly positioned on the alignment pins 282 and 284 and moved into engagement with the cover section 28, in the manner shown for the bottom or wear end plate 100 in FIG. 13, the cam ring 46 is installed. To install the cam ring 46, the cam ring is oriented with the flat circular end surface 50 facing downward (as viewed in FIG. 17) and the flat circular end surface 52 facing upward. The first alignment pin 282 is then inserted through the first alignment opening 84 in the cam ring 46 and the second alignment pin 284 is then inserted through the second alignment opening 86 in the cam ring 46.

If the first alignment pin 282 is inserted through the second alignment opening 86 in the cam ring 46 (FIGS. 3 and 4) and the second alignment pin 284 is inserted through the first alignment opening 84 in the cam ring, the cam ring will be offset to one side and will not be concentric with the cover section 28. This may be detected visually or an arm of assembly fixture, similar to the arm 296 of FIG. 17, may be used to prevent positioning of the cam ring 46 on the alignment pins 282 and 284 in a misaligned orientation.

The rotor 30 is then installed on the splined upper (as viewed in FIG. 17) end of the shaft 34. The vanes 42 are then installed in the slots 40 in the rotor 30.

The alternative top or pressure end plate 204 (FIG. 10) is then installed on the alignment pins 282 and 284. The first alignment pin 282 being inserted into the first alignment opening 226 in the top or pressure end plate 224 and the second alignment pin 284 being inserted into the second opening 228 in the alternative top or pressure end plate. The main housing section 26 is then positioned over the stack of pump components disposed on the alignment pins 282 and 284. If the alternative top or pressure end plate 204 is misaligned with the alignment pins 282 and 284, engagement of the misaligned alternative top or pressure end plate 204 with the annular inner surface 302 (FIG. 19) of the main section 26 of the housing will block engagement of the main section of the housing with the cover section 28 of the housing in the same manner as shown in FIG. 19 with the top or pressure end plate 156.

From the above description of the invention, those skilled in the art will perceive improvements, changes and modifications. Such improvements, changes and modifications within the skill of the art are intended to be covered by the appended claims.

Having described the invention, the following is claimed:

1. A rotary device for use with fluid, said device comprising:

a rotor;

a shaft connected with said rotor;

a housing enclosing said rotor, said housing having an end wall defining first and second spaced apart alignment openings and a shaft opening; and an end plate which is disposed between said rotor and said end wall of said housing and cooperates with said rotor and housing to conduct fluid flow, said end plate defining first and second spaced apart alignment openings and a shaft opening, said end plate being movable relative to said housing during assembly of said rotary device between an aligned orientation and a misaligned orientation, said first and second alignment openings and said shaft opening in said end plate being aligned with said first and second alignment openings and said shaft opening in said housing when said end plate is in the aligned orientation to thereby enable assembly of said rotary device, said shaft opening in said end plate being offset from said shaft opening in said housing when said end plate is in the misaligned orientation and said first and second alignment openings in said end plate are aligned with said first and second alignment openings in said housing to cause said end wall and said end plate to prevent assembly of said rotary device.

2. A rotary device as set forth in claim 1 further including a first member for engaging said first alignment opening in said end wall of said housing and said first alignment opening in said end plate when said rotary device is assembled with said end plate in the aligned orientation, and a second member for engaging said second alignment opening in said end wall of said housing and said second alignment opening in said end plate when said rotary device is assembled with said end plate in the aligned orientation, said shaft extending through said shaft opening in said end plate and said shaft opening in said housing when said rotary device is assembled with said end plate in the aligned orientation.

3. A rotary device as set forth in claim 1 further including a cam ring extending around said rotor, said cam ring defining first and second alignment openings which extend through said cam ring in a direction parallel to a central axis of said cam ring, said cam ring being movable relative to said housing between an aligned orientation and a misaligned orientation during assembly of said rotary device, said first and second alignment openings in said cam ring being aligned with said first and second alignment openings in said end plate and said first and second alignment openings in said housing when said cam ring is in the aligned orientation and said end plate is in the aligned orientation, said cam ring having a central axis which is offset from central axes of said shaft opening in said end plate and said shaft opening in said end wall of said housing when said cam ring is in the misaligned orientation and said end plate is in the aligned orientation.

4. A rotary device as set forth in claim 3 wherein said end plate includes first and second recess means for conducting fluid flow, said cam ring defining first and second flow passages which extend through said cam ring in a direction parallel to central axes of said first and second alignment openings in said cam ring, said first and second flow passages in said cam ring having open end portions which are aligned with portions of said first and second recess means in said end plate when said cam ring is in the aligned orientation.

5. A rotary device as set forth in claim 3 further including a first member for engaging said first alignment opening in said end wall of said housing, said first alignment opening in said end plate and said first alignment opening in said cam ring when said rotary device is assembled with said end plate and cam ring in their aligned orientations, and a second member for engaging said second alignment opening in said end wall of said housing, said second alignment opening in said end plate and said second alignment opening in said cam ring when said rotary device is assembled with said end plate and said cam ring in their aligned orientations.

6. A rotary device as set forth in claim 3 further including a second end plate disposed between said rotor and said housing to conduct fluid flow, said second end plate defining first and second alignment openings, said second end plate being movable relative to said housing between an aligned orientation and a misaligned orientation during assembly of said rotary device, said first and second alignment openings in said second end plate being aligned with said first and second alignment openings in said cam ring when said second end plate is in the aligned orientation to thereby enable assembly of said rotary device, said second end plate being offset from said cam ring when said second end plate is in the misaligned orientation to cause said second end plate and said housing to prevent assembly of said rotary device.

7. A method of assembling a rotary device for operation in either one of two directions during fluid flow through the rotary device, said method comprising the steps of:

providing a housing, a cam ring, and a rotor;

providing first and second end plates when the rotary device is to be operated in a first direction;

assembling the rotary device for operation in the first direction by enclosing the cam ring, rotor, and first and second end plates with the housing, said step of assembling the rotary device for operation in the first direction including positioning the cam ring and first and second end plates relative to the housing with a first alignment opening in the cam ring aligned with a first alignment opening in the housing and with first alignment openings in the first and second end plates aligned with the first alignment openings in the cam ring and housing, said step of positioning the cam ring and first an second end plates relative to the housing during assembly of the rotary device for operation in the first direction including aligning a second alignment opening in the cam ring with a second alignment opening in the housing and aligning second alignment openings in the first and second end plates with the second alignment openings in the cam ring and housing;

providing third and fourth end plates when the rotary device is to be operated in the second direction;

assembling the rotary device for operation in the second direction by enclosing the cam ring, rotor, and third and fourth end plates with the housing, said step of assembling the rotary device for operation in the second direction including positioning the cam ring and third and fourth end plates relative to the housing with the first alignment opening in the cam ring aligned with a third alignment opening in the housing and with first alignment openings in the third and fourth end plates aligned with the first alignment opening in the cam ring and the third alignment opening in the housing, said step of positioning the cam ring and third and fourth end plates during assembly of the rotary device for operation in the second direction including aligning the second alignment opening in the cam ring with an alignment opening in the housing and aligning second alignment openings in the third and fourth end plates with the second alignment opening in the cam ring and with the same alignment opening in the housing with which the second alignment opening in the cam ring is aligned.

8. A method as set forth in claim 7 wherein said step of providing third and fourth end plates includes providing a third end plate which is a mirror image of the first end plate and providing a fourth end plate which is a mirror image of the second end plate, the first end plate having a configuration which is different than the configuration of the second end plate.

9. A method as set forth in claim 7 wherein said step of providing a cam ring includes providing a cam ring having parallel side surfaces disposed on axially opposite sides of said cam ring, said step of assembling the rotary device for operation in the first direction including positioning the cam ring with a first side surface of the cam ring facing toward the first end plate and a wall of the housing in which the first, second, and third alignment openings in the housing are formed, said step of assembling the rotary device for operation in the second direction including positioning the cam ring with a second side surface of the cam ring facing toward the third end plate and the wall of the housing in which the first, second, and third alignment openings are formed.

10. A method as set forth in claim 7 wherein said step of assembling the rotary device for rotation in a first direction includes positioning a shaft relative to the rotor and housing with the shaft extending through a shaft opening in the housing and a shaft opening in the first end plate when the rotary device is assembled, said step of assembling the rotary device for operation in the first direction being blocked as a result of misalignment of the shaft opening in the housing and the shaft opening in the first end plate in the event the rotary device is assembled in a manner other than with the first alignment opening in the first end plate aligned with the first alignment opening in the housing, said step of assembling the rotary device for operation in the second direction including positioning a shaft relative to the rotor and housing with the shaft extending through the shaft opening in the housing and a shaft opening in the third end plate when the rotary device is assembled, said step of assembling the rotary device for operation in the second direction being blocked as a result of misalignment of the shaft opening in the housing and the shaft opening in the third end plate in the event the rotary device is assembled in a manner other than with the first alignment opening in the third end plate aligned with the third alignment opening in the housing.

11. A method as set forth in claim 7 wherein said step of assembling the rotary device for operation in the first direction further includes interconnecting the housing, cam ring, and first and second end plates with a first member which extends from the first alignment opening in the housing through first alignment openings in the first end plate and cam ring into the first alignment opening in the second end plate and with a second member which extends from the second alignment opening in the housing through the second alignment openings in the first end plate and cam ring into the second alignment opening in the second end plate.

12. A method as set forth in claim 11 wherein said step of assembling the rotary device for operation in the second direction includes interconnecting the housing, cam ring, and first and second end plates with a third member which extends from the third alignment opening in the housing through the first alignment openings in the third end plate and cam ring into the first alignment opening in the fourth end plate and with a fourth member which extends from an alignment opening in the housing through the second alignment openings in the third end plate and the cam ring into the second alignment opening in the fourth end plate.

13. A method as set forth in claim 7 wherein said step of positioning the cam ring and first and second end plates relative to the housing during assembly of the rotary device for operation in the first direction includes aligning a first fluid flow opening in the first end plate with a first end of a first flow passage in the cam ring, aligning a second fluid flow opening in the first end plate with a first end of a second flow passage in the cam ring, aligning a first fluid flow opening in the second end plate with a second end of the first flow passage in the cam ring, and aligning a second fluid flow opening in the second end plate with a second end of the second flow passage in the cam ring, said step of positioning the cam ring and third and fourth end plates during assembly of the rotary device for operation in the second direction including aligning a first fluid flow opening in the third end plate with the second end of the first flow passage in the cam ring, aligning a second fluid flow opening in the third end plate with the second end of the second flow passage in the cam ring, aligning a first fluid flow opening in the fourth end plate with the first end of the first flow passage in the cam ring, and aligning a second fluid flow opening in the fourth end plate with the first end of the second flow passage in the cam ring.

14. A method as set forth in claim 13 wherein said step of assembling the rotary device for operation in a first direction includes engaging the first end plate with a first section of the housing and engaging the second end plate with a second section of the housing, said step of assembling the rotary device for operation in a second direction including engaging the third end plate with the first section of the housing and engaging the fourth end plate with the second section of the housing.

15. A method of assembling a rotary device for operation in either one of two directions during fluid flow through the rotary device, said method comprising the steps of:

providing a cam ring, a rotor, and a housing having first and second sections;

providing first and second end plates when the rotary device is to be operated in the first direction;

assembling the rotary device for operation in the first direction by enclosing the cam ring, rotor and first and second end plates with the first and second sections of the housing, said step of assembling the rotary device for operation in the first direction including positioning a first alignment member in a first alignment opening in the first section of the housing and positioning a second alignment member in a second alignment opening in the first section of the housing with a central axis of the second alignment member extending parallel to a central axis of the first alignment member, positioning the first end plate in engagement with the first section of the housing with the first alignment member extending through a first alignment opening in the first end plate and the second alignment member extending through a second alignment opening in the first end plate, positioning the cam ring with a first side surface on the cam ring in engagement with the first end plate and with the first alignment member extending through a first alignment opening in the cam ring and the second alignment member extending through a second alignment opening in the cam ring, positioning the second end plate in engagement with a second side surface on the cam ring with the first alignment member extending into a first alignment opening in the second end plate and the second alignment member extending into a second alignment opening in the second end plate, and engaging the first housing section with the second housing section, said step of engaging the first housing section with the second housing section being at least partially blocked in the event that the rotary device is assembled in a manner other than with the first alignment member extending into the first alignment opening in the second end plate and the second alignment member extending into the second alignment opening in the second end plate;

providing third and fourth end plates when the rotary device is to be operated in the second direction; and assembling the rotary device for operation in the second direction by enclosing the cam ring, rotor, and third and fourth end plates with the first and second sections of the housing, said step of assembling the rotary device for operation in the second direction including positioning a third alignment member in a third alignment opening in the first section of the housing and positioning a fourth alignment member in an alignment opening in the first section of the housing with a central axis of the fourth alignment member extending parallel to a central axis of the third alignment member, positioning the third end plate in engagement with the first section of the housing with the third alignment member extending through a first alignment opening in the third end plate and the fourth alignment member extending through a second alignment opening in the third end plate, positioning the cam ring with the second side surface on the cam ring in engagement with the third end plate and with the third alignment member extending through the first alignment opening in the cam ring and the fourth alignment member extending through the second alignment opening in the cam ring, positioning the fourth end plate in engagement with the first side surface on the cam ring with the third alignment member extending into a first alignment opening in the fourth end plate and the fourth alignment member extending into a second alignment opening in the fourth end plate, and engaging the first housing section with the second housing section, said step of engaging the first housing section with the second housing section being at least partially blocked in the event that the rotary device is assembled in a manner other than with the third alignment member extending into the first alignment opening in the fourth end plate and the fourth alignment member extending into the second alignment opening in the fourth end plate.

16. A method as set forth in claim 15 wherein said step of assembling the rotary device for operation in a first direction includes positioning a shaft relative to the first housing section with the shaft extending through a shaft opening in the first housing section and a shaft opening in the first end plate when the rotary device is assembled, said step of assembling the rotary device for operation in the first direction being blocked as a result of interference between the first end plate and the shaft in the event the first end plate is positioned in a manner other than with the first alignment member extending through the first alignment opening in the first end plate and the second alignment member extending through the second alignment opening in the first end plate, said step of assembling the rotary device for rotation in a second direction includes positioning a shaft relative to the first housing section with the shaft extending through a shaft opening in the first housing section and a shaft opening in the third end plate when the rotary device is assembled, said step of assembling the rotary device for operation in the second direction being blocked as a result of interference between the third end plate and the shaft in the event the third end plate is positioned in a manner other than with the third alignment member extending through the first alignment opening in the third end plate and the fourth alignment member extending through the second alignment opening in the third end plate.

17. A method as set forth in claim 15 wherein said step of assembling the rotary device for operation in the first direction includes aligning a first fluid flow opening in the first end plate with a first end of a first flow passage in the cam ring, aligning a second fluid flow opening in the first end plate with a first end of a second flow passage in the cam ring, aligning a first fluid flow opening in the second end plate with a second end of the first flow passage in the cam ring, and aligning a second fluid flow opening in the second end plate with a second end of the second flow passage in the cam ring, said step of assembling the rotary device for operation in the second direction including aligning a first fluid flow opening in the third end plate with the second end of the first flow passage in the cam ring, aligning a second fluid flow opening in the third end plate with the second end of the second flow passage in the cam ring, aligning a first fluid flow opening in the fourth end plate with the first end of the first flow passage in the cam ring, and aligning a second fluid flow opening in the fourth end plate with the first end of the second flow passage in the cam ring.

18. A rotary device for use with fluid, said rotary device comprising:

a rotor;

a plurality of vanes connected with said rotor for rotation therewith;

a cam ring extending around said rotor and cooperating with said vanes to form a plurality of working chambers, said cam ring having an inner side surface with first and second segments along which the vanes move to vary the size of the working chambers during rotation of the rotor, said first segment of said inner side surface of said cam ring having the same configuration as said second segment of said inner side surface of said cam ring, said cam ring having a center plane between said first and second segments of said inner side surface of said cam ring, said cam ring having surface means defining a first alignment opening having a central axis which is disposed in the center plane of said cam ring and a second alignment opening having a central axis which is parallel to and is offset from the center plane of said cam ring;

a first end plate disposed in engagement with a first side of said cam ring and having a first alignment opening aligned with said first alignment opening in said cam ring and a second alignment opening aligned with said second alignment opening in said cam ring;

a second end plate disposed in engagement with a second side of said cam ring and having a first alignment opening aligned with said first alignment opening in said cam ring and a second alignment opening aligned with said second alignment opening in said cam ring;

a housing enclosing said cam ring and said first and second end plates;

a first alignment member connected with said housing and extending through said first alignment openings in said first end plate and said cam ring and into said first alignment opening in said second end plate; and a second alignment member connected with said housing and extending through said second alignment openings in said first end plate and said cam ring and into said second alignment opening in said second end plate.

19. A rotary device as set forth in claim 18 wherein said rotor is rotated in a first direction relative to said cam ring during operation of said pump assembly with said first and second alignment members extending through the first and second alignment openings in said cam ring, respectively, said housing including surface means for defining openings for receiving third and fourth alignment members which extend through the first and second alignment openings in said cam ring, respectively, during rotation of said rotor in a second direction.

20. A method of assembling a rotary device for operation in either one of two directions during fluid flow through the rotary device, said method comprising the steps of:

providing a cam ring having first and second side surfaces, a rotor and a housing having first and second sections;

providing first and second end plates when the rotary device is to be operated in the first direction;

assembling the rotary device for operation in the first direction by enclosing the cam ring, rotor, and first and second end plates with the first and second sections of the housing, said step of assembling the rotary device for operation in the first direction including engaging the first side surface of the cam ring with the first end plate, said step of engaging the first side surface of the cam ring with the first end plate including aligning a first fluid flow opening in the first end plate with a first end of a first flow passage in the cam ring, and aligning a second fluid flow opening in the first end plate with a first end of a second flow passage in the cam ring, engaging the second side surface of the cam ring with the second end plate, said step of engaging the second side surface of the cam ring with the second end plate including aligning a first fluid flow opening in the second end plate with a second end of the first flow passage in the cam ring, and aligning a second fluid flow opening in the second end plate with a second end of the second flow passage in the cam ring, engaging the first end plate with the first housing section, and engaging the second end plate with the second housing section;

providing third and fourth end plates when the rotary device is to be operated in the second direction;

assembling the rotary device for operation in the second direction by enclosing the cam ring, rotor, and third and fourth end plates with the first and second sections of the housing, said step of assembling the rotary device for operation in the second direction including engaging the second side surface of the cam ring with the third end plate, said step of engaging the second side surface of the cam ring with the third end plate including aligning a first fluid flow opening in the third end plate with the second end of the first flow passage in the cam ring, and aligning a second fluid flow opening in the third end plate with the second end of the second flow passage in the cam ring, engaging the first side surface of the cam ring with the fourth end plate, said step of engaging the first side surface of the cam ring with the fourth end plate including aligning a first fluid flow opening in the fourth end plate with the first end of the first flow passage in the cam ring, and aligning a second fluid flow opening in the fourth end plate with the first end of the second flow passage in the cam ring, engaging the third end plate with the first housing section, and engaging the second end plate with the fourth housing section.

21. A method as set forth in claim 20 wherein said steps of engaging the first end plate with the first housing section and engaging the second end plate with the second housing section includes engaging the first housing section with the second housing section, said step of engaging the first housing section with the second housing section being at least partially blocked in the event the rotary device is assembled in a manner other than with the first fluid flow opening in the second end plate aligned with the second end of the first flow passage in the cam ring and with the second fluid flow opening in the second end plate aligned with the second end of the second flow passage in the cam ring when the rotary device is being assembled for operation in the first direction, said steps of engaging the third end plate with the first housing section and engaging the fourth end plate with the second housing section includes engaging the first housing section with the second housing section, said step of engaging the first housing section with the second housing section being at least partially blocked in the event the rotary device is assembled in a manner other than with the first fluid flow opening in the fourth end plate aligned with the first end of the first flow passage in the cam ring and with the second fluid flow opening in the fourth end plate aligned with the first end of the second flow passage in the cam ring when the rotary device is assembled for operation in the second direction.

22. A method as set forth in claim 20 wherein said step of assembling the rotary device or operation in the first direction includes positioning a shaft relative to the first housing section with the shaft extending through a shaft opening in the first housing section and a shaft opening in the first end plate when the rotary device is assembled, said step of assembling the rotary device for operation in the first direction being blocked as a result of interference between the first end plate and the shaft in the event the first end plate is in a position other than with the first fluid flow opening in the first end plate aligned with the first end of the first flow passage in the cam ring and with the second fluid flow opening in the first end plate aligned with the first end of the second flow passage in the cam ring when the rotary device is being assembled for operation in the first direction, said step of assembling the rotary device for operation in the second direction includes positioning a shaft relative to the first housing section with the shaft extending through the shaft opening in the first housing section and a shaft opening in the third end plate when the rotary device is assembled, said step of assembling the rotary device for operation in the second direction being blocked as a result of interference between the third end plate and the shaft in the event the third end plate is in a position other than with the first fluid flow opening in the third end plate aligned with the second end of the first flow passage in the cam ring and with the second fluid flow opening in the third end plate aligned with the second end of the second flow passage in the cam ring when the rotary device is being assembled for operation in the second direction.

* * * * *